US007851118B2

(12) United States Patent
Itami et al.

(10) Patent No.: US 7,851,118 B2
(45) **Date of Patent: *Dec. 14, 2010**

(54) IMAGE FORMING METHOD, IMAGE FORMING APPARATUS AND ORGANIC PHOTORECEPTOR

(75) Inventors: Akihiko Itami, Hachioji (JP); Masao Asano, Tokyo (JP); Hiroshi Yamazaki, Hachioji (JP); Kunio Shigeta, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 615 days.

This patent is subject to a terminal disclaimer.

(21) Appl. No.: 11/229,130

(22) Filed: Sep. 17, 2005

(65) Prior Publication Data

US 2006/0088778 A1 Apr. 27, 2006

(30) Foreign Application Priority Data

Oct. 27, 2004 (JP) ..... 2004-312091

(51) Int. Cl.
*G03G 15/09* (2006.01)

(52) U.S. Cl. ..... 430/122.1; 430/122.7; 430/122.8; 430/123.3

(58) Field of Classification Search ..... 430/122.1, 430/122.7, 122.8, 123.3
See application file for complete search history.

(56) References Cited

U.S. PATENT DOCUMENTS

| | | | | |
|---|---|---|---|---|
| 5,532,803 | A * | 7/1996 | Yasuda et al. | 399/276 |
| 6,078,768 | A * | 6/2000 | Suzuki | 399/257 |
| 7,473,509 | B2 * | 1/2009 | Itami et al. | 430/123.42 |
| 2003/0082470 | A1 * | 5/2003 | Asano et al. | 430/60 |
| 2006/0110675 | A1 * | 5/2006 | Itami et al. | 430/122 |
| 2006/0115754 | A1 * | 6/2006 | Itami et al. | 430/45 |
| 2006/0115761 | A1 * | 6/2006 | Itami et al. | 430/122 |

* cited by examiner

*Primary Examiner*—Hoa V Le
(74) *Attorney, Agent, or Firm*—Lucas & Mercanti, LLP

(57) ABSTRACT

An image forming method, comprising: forming an electrostatic latent image on a rotatable organic photoreceptor; forming a developing brush with a developing agent containing a toner on a rotatable developing sleeve; and bringing the developing brush in contact with the photoreceptor at a developing region so as to visualize the electrostatic latent image into a toner image. The photoreceptor comprises a conductive support member, an intermediate layer containing a binder resin and inorganic particles which have a number average primary order particle size of 3 to 200 nm, and a photosensitive layer provided on the intermediate layer, and the rotating direction of the developing sleeve is counter to that of the photoreceptor at the developing region.

13 Claims, 2 Drawing Sheets

IMAGE FORMING METHOD, IMAGE FORMING APPARATUS AND ORGANIC PHOTORECEPTOR

BACKGROUND

1. Field of the Invention

The present invention relates to an image forming method used for the image formation of the electronic photographing method, an image forming apparatus and an organic photoreceptor, and in more detail, to an image forming method used for the image formation of the electronic photographing system used in a field of a copier or a printer, an image forming apparatus and an organic photoreceptor (hereinafter, simply called photoreceptor).

2. The Description of Related Art

Recently, the function separation type organic photoreceptor in which functions for generating the electronic charge and for charge transportation are made in charge to different materials, becomes the main stream, for example, a laminated type photoreceptor in which the charge generating layer, charge transporting layer are laminated through the intermediate layer on the conductive supporting body, is widely used (Patent Document 1).

Further, when looks at the electronic photographic process, in the latent image formation system, it is largely separated into an analog image formation using the halogen lamp as a light source and a digital system image formation using LED or laser as a light source. Recently, as a printer for hard-copy of the personal computer, further, also in the normal copier, from the easiness of the image processing or the easiness of the development to the composite machine, the digital system latent image formation system is rapidly becoming the main stream.

Further, in the digital system image formation method, the opportunity for making the print image of the original is increased, and the requirement for the high quality image is increased. For the high quality image-making of the electronic photographing image, a technology by which the minute latent image formation is conducted by using the light source for exposure whose spot diameter is small, on the organic photoreceptor, and the minute dot image is formed, is developed. For example, by using the light source whose spot diameter is less than 4000 $\mu m^2$, a method by which the high accurate latent image is formed on the organic photoreceptor is well known (Patent Document 2). Even when the high density dot exposure is conducted by such a small diameter spot, the organic photoreceptor by which the high density and uniform latent image can be formed by the dot exposure, and the structure of the developing mode by which the latent image can be reproduced as a toner image, are not yet attained sufficiently. Further, in a dot image, there are problems that a transverse line image becomes thin (a phenomenon in which a one dot line image formed in a direction perpendicular to a paper conveying direction becomes thin in comparison with one dot line image formed in the paper conveying direction), and a trailing edge becomes white omission (a phenomenon in which the image density of a trailing edge portion of a halftone picture image in the paper conveying direction is lowered than the leading edge portion or the trailing edge portion is not developed).

That is, as the developing method of the latent image on the organic photoreceptor, a developing mode by which the developing sleeve oppositely provided to the organic photoreceptor is advanced in parallel with the advancing direction of the organic photoreceptor in the developing area (hereinafter, parallel developing mode), and a developing mode by which the developing sleeve is advanced in the counter direction (hereinafter, counter developing mode) are well known, however, for both, when the high density dot image is formed, the problems can not be solved sufficiently.

In the parallel developing mode by which the developing sleeve oppositely provided to the organic photoreceptor is advanced in parallel with the advancing direction of the organic photoreceptor, the developing property of the periphery of the high density image is deteriorated, and is easily brought to the insufficient density, and in the photographic image whose contrast is high, the image quality is easily deteriorated.

On the one hand, in the counter developing mode by which the developing sleeve is advanced in the counter direction, the developing property is high, and the high density dot image can be formed, however, the fog is often generated, and the insufficient density is easily generated in the leading edge part.

Further, recently, a fine unevenness trouble so called a worm-like unevenness becomes a problem. Although the cause of this worm-like unevenness has not clarified sufficiently, it may be considered that when a relative velocity between a photoreceptor and a developing sleeve becomes faster and a triboelectric charging between a magnetic brush of a developer and a photoreceptor becomes stronger, the worm-like unevenness may occur. For this reason, in comparison with the parallel developing mode, the worm-like unevenness tends to occur in the counter developing mode. Further, the worm-like unevenness has a relative relationship with a frequency of the developing bias such that if the frequency becomes higher, the worm-like unevenness becomes fewer. However, when the frequency becomes higher, there is a tendency that the sharpness of an image becomes lowered. That is, it may be difficult to satisfy both of the reduction of the worm-like unevenness and the sharpness of an image.

The phenomena as described above, are not solved enough simply by only the improvement of the developer, but it is found that also by the characteristic of the organic photoreceptor, these phenomena are deteriorated or improved.

That is, it is presumed that these phenomena relate to the contrast of the electro-static latent image formed on the organic photoreceptor, or also to the generation of the inverse charge toner by the rubbing of the organic photoreceptor and the developer.

[Patent Document 1] Tokkai No. 2004-133018

[Patent Document 2] Tokkaihei No. 8-272197

SUMMARY

In view of the foregoing, an object of the invention is to provide a useful image forming method, image forming apparatus or photoreceptor.

An aspect is an image forming method, the method comprises:

forming an electrostatic latent image on a rotatable organic photoreceptor;

forming a developing brush with a developing agent containing a toner on a rotatable developing sleeve; and bringing the developing brush in contact with the photoreceptor at a developing region so as to visualize the electrostatic latent image into a toner image;

wherein the photoreceptor comprises a conductive support member, an intermediate layer containing a binder resin and inorganic particles which have a number average primary order particle size in the range of 3 to 200 nm, and a photosensitive layer provided on the intermediate layer, and the rotating direction of the developing sleeve is counter to that of the photoreceptor at the developing region.

Another aspect can be an image forming apparatus performing the above image forming method.

Another aspect can be an organic photoreceptor for the method above.

DETAILED DESCRIPTION OF THE PREFERRED EMBODIMENT

Figure 1:
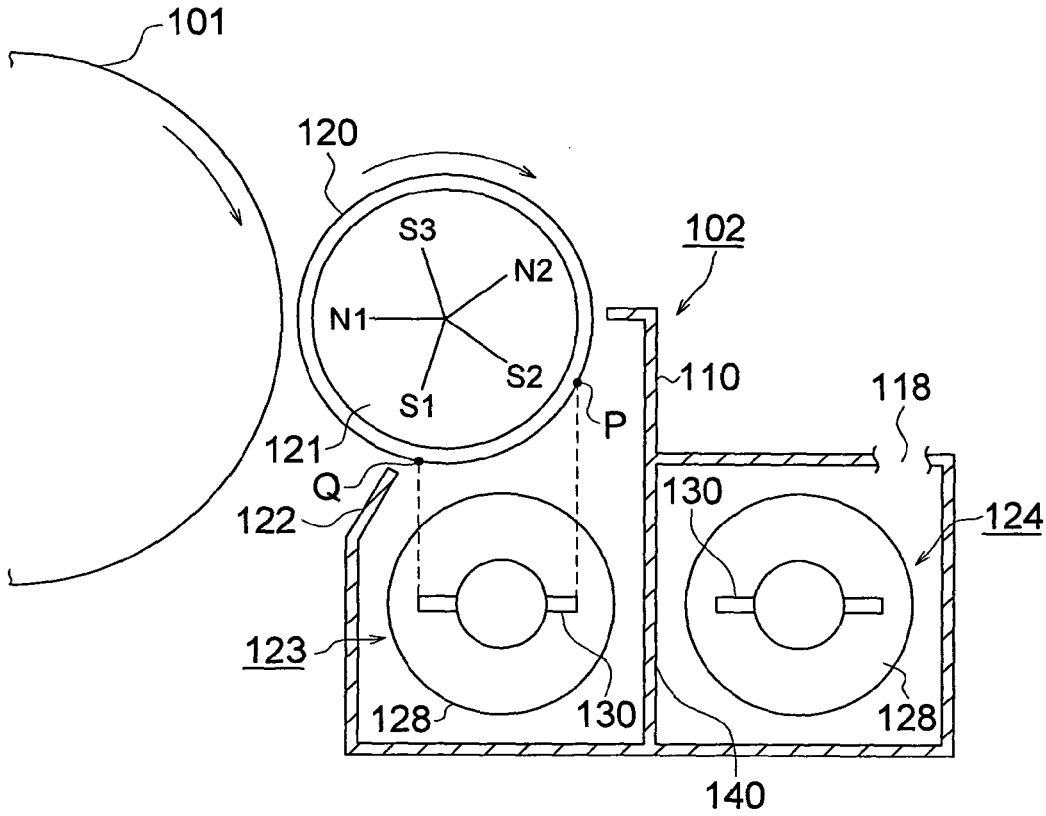
FIG. 1 is a view showing a cross section of a developing device of a counter direction developing method.

The present invention will be described in detail bellow.

The present invention can solve the above-described problems of the conventional technology, that is, solve problems easily generated in the counter developing mode such as the occurrence of fog, a partial image density shortage, and a worm-like unevenness, and relates to the organic photoreceptor for stably forming the highly accurate digital image, and in more detail, an object of the present invention is to provide an image forming method and an image forming apparatus by which the generation of uneven image based on the fog, a leading edge part density lowering or a worm-like unevenness which are easily generated in the counter developing mode, is prevented, and the electronic photographing image whose image density is high and whose color reproducibility is good, can be produced, and to provide the organic photoreceptor applied for the image forming method.

In order to solve the above-described problems of the present invention, that is, the generation of the fog, a partial insufficient density or a worm-like unevenness which are easily generated in the counter developing mode, and in order to obtain the uniform and highly accurate electronic photographing image, as a result of the consideration of the relationship between the structure of the photosensitive layer of the organic photoreceptor and the developing mode, in order to prevent the generation of the fog, the density failure of the image leading edge part and the worm-like unevenness in the counter system whose developing property is excellent, it has been found that it is effective when the intermediate layer in which the rectifying property of the charge carrier is improved, is provided on the organic photoreceptor, and the present invention is established.

Namely, by making a counter developing mode proper, the problems of the generation of uneven image based on the fog and the leading edge part density lowering can be improved. However, it has not been attained to satisfy both requirements of the prevention of the unevenness trouble so called a worm-like unevenness and the enhancement of the sharpness. As a result of the study by the inventor, by using a photoreceptor having an intermediate layer according to the invention in the counter developing mode, it has been learned that the above both requirements can be attained, in addition, the problems of the occurrence of fog and the density shortage at the image leading portion can be improved. Although the reason why the both requirements of the prevention of the unevenness trouble so called a worm-like unevenness and the enhancement of the sharpness can be attained is not clear, it is presumed that a blocking function with reference to the size of inorganic particles in the intermediate layer according to the invention causes the same effect by increasing the frequency of the developing bias.

An image forming method of the present invention is an image forming method by which the electrostatic latent image is formed on an organic photoreceptor, a developing brush is formed by a developing agent containing toner is formed on a cylindrical developing sleeve, the developing brush is brought into contact with the organic photoreceptor, and the electrostatic latent image is visualized to the toner image, and is characterized in that: the organic photoreceptor has the photosensitive layer and the intermediate layer including inorganic particles whose average primary particle diameter is 3-200 nm in the binder resin on the conductive supporting body; and while the developing sleeve is rotated in the counter direction, the electro-static latent image is visualized into the toner image.

When the image forming method has the above-described structure, the generation of the fog or the density shortage of the leading edge part which are easily generated by the counter developing mode, can be prevented, and the high image quality digital image or color image can be provided.

The organic photoreceptor according to the present invention will be described. The organic photoreceptor used for the present invention has the photosensitive layer and the intermediate layer including inorganic particles whose average primary particle is 3-200 nm in the binder resin on the conductive supporting body.

When the organic photoreceptor has the structure as described above, the generation of the fog or the density poorness of the leading edge part which are easily generated by the counter developing mode, can be prevented, and the high image quality digital image or color image can be provided.

The structure of the organic photoreceptor according to the present invention will be described below.

In the present invention, the organic photoreceptor means an electronic photographing photoreceptor structured when at least one function of the charge generation function and the charge transport function which are necessarily essential to the structure of the electronic photographing photoreceptor, is given to the organic compound, and all of the photoreceptor structured by the publicly known organic charge generation material or organic charge transport material and the publicly known organic photoreceptor such as the photoreceptor in which the charge generation function and the charge transport function are structured by the high polymer complex are included.

In the structure of the photoreceptor according to the present invention, the structure in which the charge generating layer and the charge transporting layer as the photosensitive layer are successively laminated on the electric conductive supporting body, is preferable. Further, it is preferable that the intermediate layer is provided between the conductive supporting body and the photosensitive layer, further, as necessary, the structure in which the surface protective layer is further formed on the photosensitive layer, may also be allowed.

Hereinafter, a preferable concrete example of a layer construction of an organic photoreceptor according to the invention will be described.

Conductive Supporting Member:

A cylindrical conductive supporting member may be used as the conductive supporting member for the photoreceptor of the invention.

The cylindrical conductive supporting member can be defined as a cylindrical support required forming images on an endless basis through rotation. The preferred cylindricity is 5 through 40 μm, and the more preferred one is 7 through 30 μm.

The cylindricity is based on the JIS (B0621-1984). To be more specific, when a cylindrical substrate is sandwiched between two coaxial geometrical cylinders, the cylindricity is expressed in terms of the difference of the radii at the position where a space between two coaxial cylinders is minimized. In the present invention, the difference in the radii is expressed in "μm". The cylindricity is gained by measuring the roundness at a total of seven points—two points 10 mm from both ends of the cylindrical substrate, a center, and four points obtained by dividing the space between both points and the center into three equal parts. A non-contact type universal roll diameter measuring instrument (by Mitsutoyo Co., Ltd.) can be used for this measurement.

The conductive supporting member may include a metallic drum made of aluminum, nickel or the like, a plastic drum formed by vapor deposition of aluminum, tin oxide, indium oxide or the like, or a paper/plastic drum coated with conductive substance. The conductive supporting member is preferred to have a specific resistance of $10^3$ Ωcm or less at the normal temperature.

A conductive supporting member wherein the alumite film provided with porous sealing treatment on the surface is formed may be used. Alumite treatment is normally carried out in the acid bath containing a chromium oxide, sulfuric acid, oxalic acid, phosphoric acid, sulfamic acid or others. In sulfuric acid, the best result is obtained by anodization. In the case of anodization in sulfuric acid, preferred conditions include a sulfuric acid concentration of 100 through 200 g/l, aluminum ion concentration of 1 through 10 g/l, liquid temperature of around 20° C., and applied voltage of about 20 volts, without the preferred conditions being restricted thereto. The average thickness of the film formed by anodization is normally equal to or smaller than 20 μm, and is preferred to be equal to or smaller than 10 μm, in particular.

Moreover, in the organic photoreceptor of the present invention, when the outside diameter of a cylindrical base support is 20-80 mm, effect becomes larger. When the outside diameter of the cylindrical base support is 20-80 mm, the surface linear velocity of the photoreceptor in an image formation process tends to become high-speed, and it is easy to generate image unevenness and fog by a counter developing mode.

Intermediate Layer

An intermediate layer is provided between the conductive supporting member and photosensitive layer in the organic photoreceptor according to the invention. In the intermediate layer, inorganic particles having a number average primary order particle size of 3-200 nm are contained in a binder resin. With the structure in which inorganic particles are contained in a binder resin of the intermediate layer, the blocking capability for free carriers (electron and hole which come from a conductive base support) from a conductive base support can be improved, the generation of black spots or fog can be prevented, and the developing capability can be increased, the generation of unevenness can be prevented so that electrophotographic picture images with an enough image density can be obtained. The number average primary order particle-size of the fine particles is obtained by the following. The fine particles are magnified by a factor of 10,000 according to a transmission electron microscope, and one hundred particles are randomly selected as primary order particles from the magnified particles, and the number average primary order particle size are obtained by measuring an average value of the FERET diameter according to image analysis.

As inorganic particles used for the intermediate layer according to the present invention, metal oxides, such as a titanium oxide (TiO2), a zinc oxide (ZnO), a tin oxide (SnO2), a zirconium oxide, a cerium oxide, an iron oxide, an aluminium oxide, a tungstic oxide, and a bismuth oxide, are used preferably, and further, metallic carbide, such as silicon carbide and titanium carbide, titanate such as strontium titanate, titanic acid calcium, and barium titanate, carbonate such as calcium carbonate, metal nitrides, such as aluminium nitride, and sulfate such as barium sulfate, copper sulfate, and zinc sulfate etc. may be used.

Among these inorganic particles, inorganic particles preferably used for the present invention may be N-type semiconductive particles desirably.

The N-type semiconductive fine particles means that main charge carriers are particles of electrons. That is, since main charge carriers are particles of electrons, the intermediate layer in which the N-type semiconductive fine particles are contained in the insulating binder, effectively blocks the hole injection from the conductive base support and has a property having a transporting capability for the electron from the photosensitive layer.

The N-type semiconductive particles include the particles of titanium oxide ($TiO_2$), zinc oxide (ZnO) and tin oxide ($SnO_2$), and the titanium oxide is preferable.

As the N-type semiconductive particles, fine particles having the number average primary particle diameter of 3.0 nm to 200 nm, more preferably 5 to 100 nm may be used. The N-type semiconductive particles having the number average primary order particle size of 3.0 nm or less hardly form an even dispersion in the intermediate layer binder and tend to form agglomerated particles, whereby the agglomerated particles act as a charge trap so as to generate a residual electric potential and fog tens to occur. On the other hand, the N-type semiconductive particles having the number average primary order particle size of 200 nm or more tend to form large convex/concave on the surface of the intermediate layer and image irregularities tend to occur by these large convex/concave. Further, the N-type semiconductive particles having the number average primary order particle size of 200 nm or more tend to precipitate in dispersion liquid and agglomerated particles tend to occur. As a result, image irregularity tend to occur.

Titanium oxide is available in various crystal types such as anatase, rutile and amorphous type. Of these types, the rutile type titanium oxide pigment or anatase type titanium oxide pigment is particularly preferred since it enhances rectifying characteristics of charge through the intermediate layer, i.e., mobility of electron, whereby charge potential is stabilized and generation of transfer memory is prohibited as well as increase of residual potential is prohibited.

As the N-type semiconductive particles, a compound which is a polymer containing a methylhydrogensilixane unit and was subjected to a surface treatment compound is preferably used. The hydrogenpolysiloxane having a molecular weight of from 1,000 to 20,000 is easily available and shows a suitable black spot inhibiting ability, and gives good half tone image.

The polymer containing a methylhydrogensilixane unit is preferably a copolymer of a structural unit of —($HSi(CH_3)O$)— and another siloxane unit. Preferable another siloxane unit is a dimethylsioxane unit, a methylethylsiloxane unit, a methylphenylsiloxane unit and a diethylsiloxane unit, and the dimethylsiloxane unit is particularly preferred. The ratio of the methylhydrogensiloxane unit in the copolymer is from 10 to 99 mole percent, and preferably from 20 to 90 mole percent.

The methylhydrogensiloxane copolymer is preferably a random copolymer or a block copolymer, even though a random copolymer, a lock copolymer and a graft copolymer are usable. The copolymerizing composition other than the methylhydrogensiloxane may be one or more kinds.

The N-type semiconductor particle may be one subjected to surface treatment by a reactive organic compound represented by the following formula.

$$(R)_n—Si—(X)_{4-n}$$

In the above, Si is a silicon atom, R is an organic group directly bonded by the carbon atom thereof to the silicone atom, X is a hydrolyzable group and n is an integer of 0 to 3.

In the organic silicone compound represented by the above formula, the organic group represented by R which is directly bonded by the carbon atom thereof to the silicone atom is, for example, an alkyl group such as a methyl group, an ethyl group, a propyl group, a butyl group, a pentyl group, a hexyl group, an octyl group and a dodecyl group; an aryl group such as a phenyl group, a tolyl group, a naphthyl group and a biphenyl group; an epoxy group-containing group such as a γ-glycidoxypropyl group and a β-(3,4-epoxycyclohexyl) ethyl group; a (metha)acryloyl group-containing group such as a γ-acryloxypropyl group and a γ-methacryloxypropyl group; a hydroxyl group-containing group such as a γ-hydroxypropyl group and a 2,3-dihydroxypropyloxypropyl group, a vinyl group-containing group such as a vinyl group and a propenyl group; a mercapto group-containing group such as a γ-mercaptopropyl group: an amino group-containing such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluoroctylethyl group; and a nitro group and a cyano-substituted alkyl group. Examples of the hydrolyzable group include an alkoxy group such as a methoxy group and an ethoxy group; a halogen atom and an acyloxy group.

The organic silicone compound represented by the foregoing may be employed singly or in combination of two or more kinds thereof.

In the compounds represented by the foregoing organic silicone compound, plural groups represented by R may be the same or different when n is 2 or more. Similarly, plural groups represented by X may be the same or different when n is 2 or more. Further, when at least two types of organic silicon compounds represented by General Formula (1) are employed, R and X, in each compound, may be the same or different.

The N-type semiconductor particle may be subjected to a surface treatment by alumina or silica before the surface treatment by the nethylhydrogensiloxane copolymer or the reactive organic silicone compound.

The treatment by alumina and that by silica may be performed simultaneously, and it is particularly preferable that the treatment by alumina is firstly carried out and then the treatment by silica is provided. The amount of silica is preferably larger than that of alumina when the treatments by alumina and silica are applied.

The surface treatment of the N-type semiconductor fine particle such as titanium oxide by alumina, silica or zirconia can be performed by a wet method. For example, the surface-treated N-type semiconductor particle can be prepared as follows.

When titanium oxide particle is employed as the N-type semiconductor particle, aqueous slurry is prepared by dispersing titanium oxide particles having a number average primary particle diameter of 50 nm in a concentration of from 50 to 350 g/L, and a water-soluble silicate or a water-soluble aluminum compound is added to the slurry. After that, the slurry is neutralized by adding an alkali or an acid so as to precipitate silica or alumina onto the surface of the titanium oxide particles. And then the particles are filtered, washed and dried for obtaining the objective surface-treated titanium oxide. When sodium silicate is employed as the water-soluble silicate, the neutralization can be carried out by an acid such as sulfuric acid, nitric acid hydrochloric acid. When aluminum sulfate is employed as the water-soluble aluminum compound, the neutralization can be performed by an alkali such as sodium hydroxide and potassium hydroxide.

An intermediate layer coating liquid prepared for forming the intermediate layer employed in the invention is constituted by a binder and a dispersing solvent additional to the surface-treated N-type semiconductor particles.

The ratio of the N-type semiconductor particles to the binder resin in the intermediate layer is preferably from 1.0 to 2.0 times of the binder resin in the volume ratio. By employing the N-type semiconductor particles in such the high density in the intermediate layer, a rectifying ability of the intermediate layer is increased so that the increasing of the remaining potential and the transfer memory are not caused even when the thickness of the layer is increased, the black spots can be effectively prevented and the suitable organic photoreceptor with small potential fluctuation can be prepared. In the intermediate layer, 100 to 200 parts by volume of the N-type semiconductor particles are preferably employed to 100 parts by volume the binder resin.

As the binder for dispersing the particles and forming the interlayer, polyamide resins are preferable for obtaining good dispersing state, the following polyamide resins are particularly preferred.

Polyamide resins each having a heat of fusion of from 0 to 40 J/g and a water absorption degree of not more than 5% are preferable for the binder of the interlayer. The heat of fusion of the resin is preferably from 0 to 30 J/g, and most preferably from 0 to 20 J/g. By such the polyamide resins, the moisture content is suitably kept, and the occurrence of the dielectric breakdown and the black spot, increasing of the remaining potential and the formation of fog are inhibited. Accordingly, the water absorption degree is more preferably not more than 4%.

The heat of fusion of the resin is measured by differential scanning calorimetry (DSC). Another method may be utilized as long as a result the same as that obtained by DSC can be obtained. The heat of fusion is obtained from the area of endothermic peak in the course of temperature rising in the DSC measurement.

The water absorption degree of the resin is measured by the weight variation by a water immersion method or Karl-Fischer's method.

As the binder resin of the interlayer, a resin superior in the solubility in solvent is necessary for forming the interlayer having a uniform layer thickness. Alcohol-soluble polyamide resins are preferable for the binder resin of the interlayer. As such the alcohol-soluble polyamide resin, copolymerized polyamide resins having a short carbon chain between the amide bond such as 6-Nylon and methoxymethylized polyamide resins have been known. These resins have high water absorption degree, and the interlayer employing such the polyamide tends to have high dependency on the environmental condition. Consequently, the sensitivity and the charge property are easily varied under high temperature and high humidity or low temperature and low humidity condition, and the dielectric breakdown and the black spots occur easily.

In the invention, the alcohol-soluble polyamide resins having a heat of fusion of from 0 to 40 J/g and a water absorption degree of not more than 5% by weight are employed to improve such the shortcoming of the usual alcohol-soluble polyamide resin. Thus good electrophotographic image can be obtained even when the exterior environmental conditions are changed and the electrophotographic photoreceptor is continuously used for a prolonged period.

The alcohol-soluble polyamide resin having a heat of fusion of from 0 to 40 J/g and a water absorption degree of not more than 5% by weight is described below.

It is preferable that the alcohol-soluble polyamide resins contains structural repeating units each having a number of carbon atoms between the amide bonding of from 7 to 30 in a ratio of from 40 to 100 Mole-% of the entire repeating units.

The repeating unit means an amide bonding unit constituting the polyamide resin. Such the matter is described below referring the an examples of polyamide resin (Type A) in which the repeating unit is formed by condensation of compounds each having both of an amino group and a carboxylic acid group and examples of the polyamide resin (Type B) in which the repeating unit is formed by condensation of a diamino compound and a di-carboxylic acid compound.

The repeating unit structure of Type A is represented by Formula 5, in which the number of carbon atoms included in X is the carbon number of the amide bond unit in the repeating unit. The repeating unit structure of Type B is represented by Formula 6, in which both of the number of carbon atoms included in Y and that included in Z are each the number of carbon atoms of the amide bond in the repeating unit structure.

Formula 1

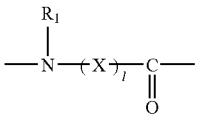

In the above, $R_1$ is a hydrogen atom or a substituted or unsubstituted alkyl group; X is an alkylene group, a group containing di-valent cycloalkane group or a group having mixed structure of the above; the above groups represented by X may have a substituent; and 1 is a natural number.

Formula 2

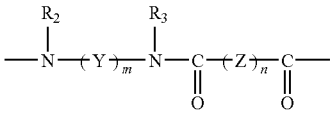

$R_2$ and $R_3$ are each a hydrogen atom, a substituted or unsubstituted alkyl group; Y and Z are each an alkylene group, a group containing a di-valent cycloalkane group or a group having mixed structure of the above, the above groups represented by Y and Z each may have a substituent; and m and n are each a natural number.

Examples of the structure of repeating unit having carbon atoms of from 7 to 30 are a substituted or unsubstituted alkylene group, an alkylene group, a group containing a di-valent cycloalkane group or a group having mixed structure of the above, and the above groups represented by Y and Z each may have a substituent. Among them the structures having the di-valent cycloalkane groups are preferred.

In the polyamide resin to be used in the invention, the number of the carbon atoms between the amide bonds of the repeating unit structure is from 7 to 30 for inhibiting the hygroscopic property of the polyamide resin so that the photographic properties, particularly the humidity dependency of the potential on the occasion of the repeating use is made small and the occurrence of the image defects such as the black spots is inhibited without lowering of the solubility of the resin in the solvent for coating.

The carbon number is preferably from 9 to 25, more preferably from 11 to 20. The ratio of the structural repeating unit having from 7 to 30 between the amide bonds to the entire repeating units is from 40 to 100 mole-percent, preferably from 60 to 100 mole-percent, and further preferably from 80 to 100 mole-percent.

Number of carbon atoms of polyamide is preferably 7-30, since such polyamide has adequate hygroscopicity and good solubility in solvent for coating composition.

Polyamide resins having a repeating unit structure represented by Formula 7 are preferred.

Formula 3

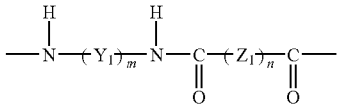

In the above, $Y_1$ is a di-valent group containing an alkyl-substituted cycloalkane group, $Z_1$ is a methylene group, m is an integer of from 1 to 3 and n is an integer of 3 to 20.

The polyamide resins in which the group represented by $Y_1$ is the group represented by the following formula are preferable since such the polyamide resins display considerable improving effect on the black spot occurrence.

Formula 4

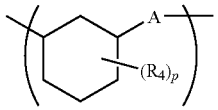

In the above, A is a simple bond or an alkylene group having from 1 to 4 carbon atoms; $R_4$ is an alkyl group; and p is a natural number of from 1 to 5. Plural $R_4$ may be the same as or different from each other.

Concrete examples of the polyamide resin are shown below.

N-1

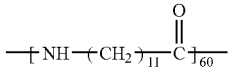

-continued
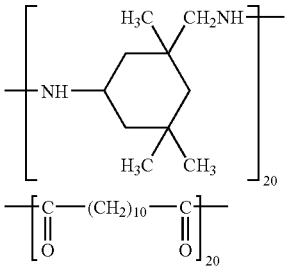
(100%)
N-2
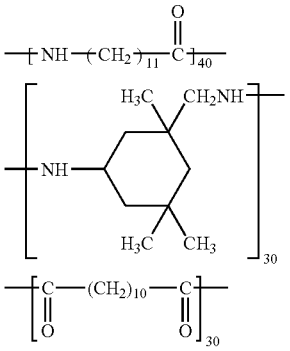
(100%)
N-3
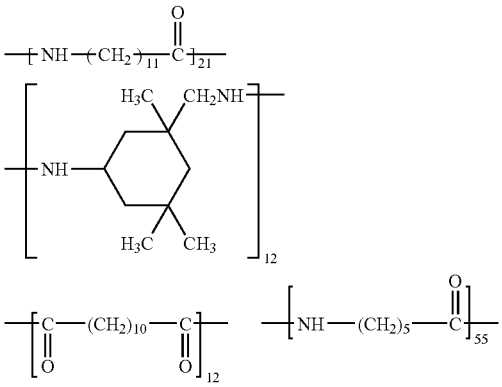
(45%)
N-4
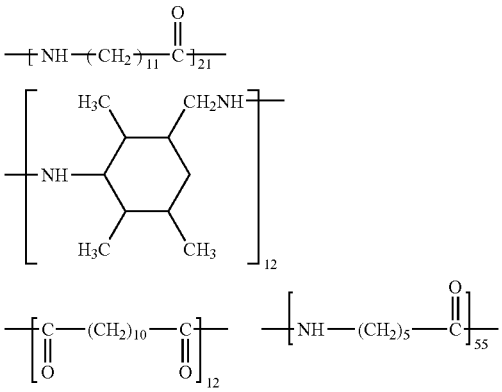
(45%)
N-5
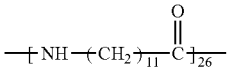
-continued
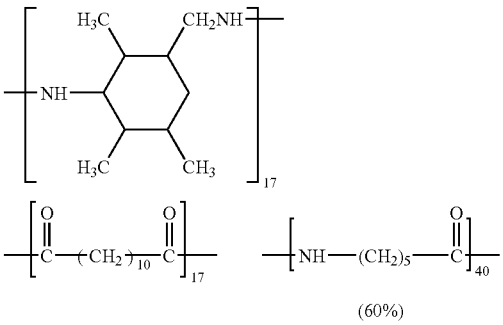
(60%)
N-6
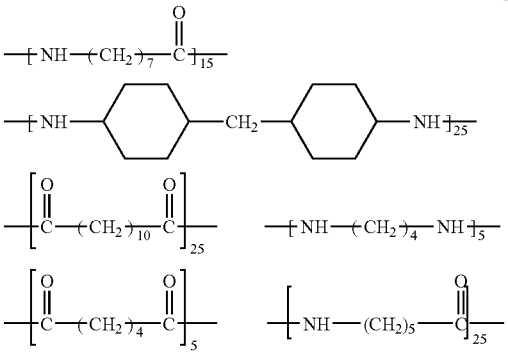
(65%)
N-7
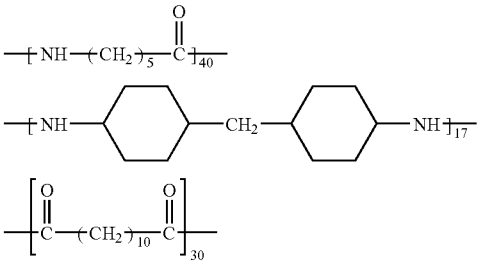
(60%)
N-8
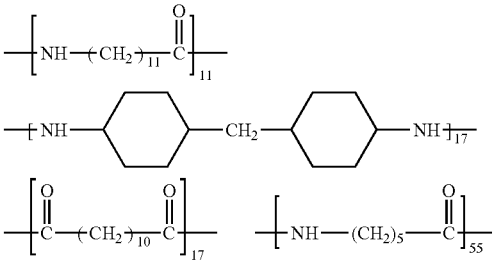
(45%)
N-9
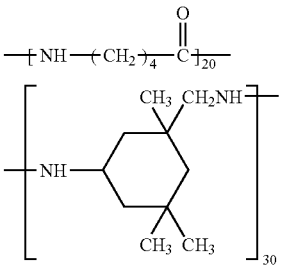

-continued

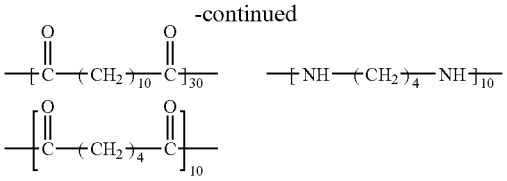

(80%)

N-10

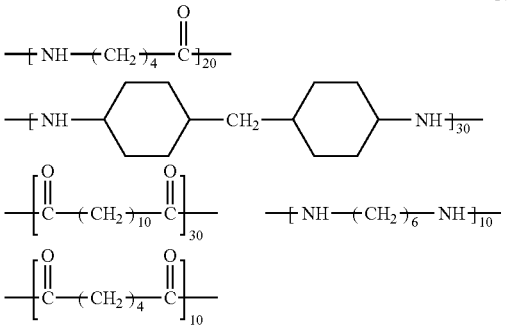

(60%)

N-11

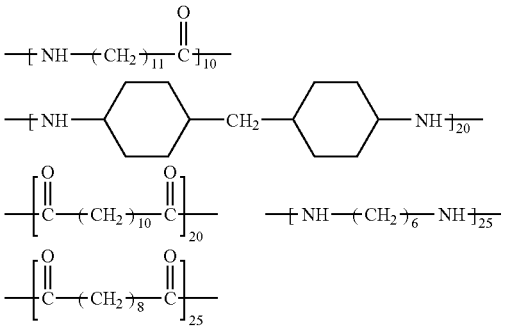

(75%)

In the above concrete examples, percentage shown in the parentheses represents the ratio in terms of mole-% of the repeating units having the 7 or more atoms between the amide bonds.

Among the above examples, the polyamide resins of N-1 through N-4 having the repeating unit represented by Formula 7 are particularly preferred.

The molecular weight of the polyamide resins is preferably from 5,000 to 80,000, more preferably from 10,000 to 60,000, in terms of number average molecular weight, because the uniformity of the thickness of the coated layer is satisfactory and the effects of the invention are sufficiently realized, and the solubility of the resin in the solvent is suitable, formation the coagulates of the resin in the interlayer and the occurrence of the image defects such as the black spots are inhibited.

The polyamide resin, for example, VESTAMELT X1010 and X4685, manufactured by Daicel•Degussa Ltd., are available in the market, and it is easy to prepare in a usual method. An example of the synthesis method is described.

Synthesis of Exemplified Polyamide Resin N-1

In a polymerization kettle, to which a stirrer, nitrogen, a nitrogen gas introducing pipe, a thermometer and a dehydration tube were attached, 215 parts by weight of lauryllactam, 112 parts by weight of 3-aminomethyl-3,5,5-trimethylcyclohexylamine, 153 parts by weight of 1,12-dodecane dicarboxylic acid and 2 parts by weight of water were mixed and reacted for 9 hours while applying heat and pressure and removing water by distillation. The resultant polymer was taken out and the composition of the copolymer was determined by $C^{13}$-NMR, the composition of the polymer agreed with that of N-11. The melt flow index (MFI) of the above-synthesized copolymer was 5 g/10 min under the condition of 230° C./2.16 kg.

As the solvent for preparing the coating liquid, alcohols having 2 through 4 carbon atoms such as ethanol, n-propyl alcohol, iso-propyl alcohol, n-butanol, t-butanol and sec-butanol are preferable from the viewpoint of the solubility of the polyamide resin and the coating suitability of the prepared coating liquid. These solvents are employed in a ratio of from 30 to 100%, preferably from 40 to 100%, and further preferably from 50 to 100%, by weight of the entire solvent amount. As solvent aid giving preferable effects when it is used together with the foregoing solvents, methanol, benzyl alcohol, toluene, methylene chloride, cyclohexanone and tetrahydrofuran are preferable.

Thickness of the interlayer is preferably 0.3-10 μm, and more preferably 0.5-5 μm, in view of minimized generation of black spots and non-uniform image at half tone area, inhibiting increase of residual potential and generation of transfer memory, whereby good image having high sharpness can be obtained.

The interlayer is substantially an insulation layer. The volume resistivity of the insulation layer is not less than $1\times10^{8}$ •·cm. The volume resistivity of the interlayer and the protective layer is preferably from $1\times10^{8}$ to $1\times10^{15}$ Ω·cm, more preferably from $1\times10^{9}$ to $1\times10^{14}$ Ω·cm, and further preferably from $2\times10^{9}$ to $1\times10^{13}$ Ω·cm. The volume resistivity can be measured as follows.

Measuring Condition: According to JIS C2318-1975

Measuring Apparatus: Hiresta IP manufactured by Mitsubishi Chemical Corporation.

Measuring Condition: Measuring prove HRS

Applied Voltage: 500 V

Measuring Environment: 30±2° C., 80±5% RH

As a solvent for preparing the coating solution for forming an intermediate layer, it can be selected arbitrary from a well-known organic solvent, for example, an alcoholic based solvent, an aromatic based solvent, a halogenated hydrocarbon based solvent, a ketone based solvent, a ketone alcohol based solvent, an ether based solvent, an ester based solvent, etc.

For example, a usual organic solvent, such as methanol, ethanol, n-propanol, iso-propanol, n-butanol, benzyl alcohol, methylselsolb, ethylselsolb, acetone, methyl ethyl ketone, cyclohexanone, methyl acetate, an ethylacetate, acetic acid n-butyl, dioxane, tetrahydrofuran, methylene chloride, chloroform, chlorobenzene, and toluene, can be used.

Moreover, these solvents used for dispersion can be used solely or in a mixture of to kinds or more. When mixed, as a usable solvent, any one can be used if it can solve a binder resin as a mixed solvent.

As a way of dispersing the inorganic particles having subjected to a surface treatment by the use of a coupling agent etc. in a binder resin, the method of a roll mill, a ball mill, an oscillating ball mill, an atolighter, a sandmill, a colloid mill, a paint shaker, etc. can be used.

Light Sensitive Layer

Charge Generating Layer (CGL)

A charge generation layer is a layer which contains charge generating substances (CGM) as a main component, and binder resin may be used for it if needed.

As a charge generating substance, a well-know material can be used. For example, a phthalocyanine based pigment, such as a metal phthalocyanine and a non-metal phthalocyanine, an azrenium salt pigment, a square rick acid metin pigment, an azo pigment having a carbazole frame, an azo pigment having a triphenylamine frame, an azo pigment having a diphenylamine frame, an azo pigment having a dibenzo thiophene frame, an azo pigment having a fluorenone frame, an azo pigment having an oxydiazole frame, an azo pigment having a bis stilbene frame, an azo pigment having a distyryl oxydiazole frame, an azo pigment having a distyryl carbazole frame, a perylene based pigment, an anthraquinone based or multi-ring quinone based pigment, a quinone imine based pigment, a diphenylmethane and triphenylmethane based pigment, benzoquinone and naphthoquinone based pigment, cyanine and azo methine based pigment, an indigo based pigment, and a bis benzimidazole based pigment, etc. may be used.

Among the above CGM, when a phthalocyanine based pigment is used, the effect of the present invention appears significantly. Although an organic photoreceptor employing a titanyl phthalocyanine pigment, or a gallium phthalocyanine pigment, etc. as a charge generating material tends to change its potential characteristic easily, if the intermediate layer according to a present invention is used, potential change is improved, whereby even if an image forming method of a counter developing mode is used, the generation of fog can be prevented, and the generation that image density is lowered partially on a image leading portion and so on can be prevented.

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably 20 to 600 weight parts of a charge generating material for 100 weight parts of the binder resin. An increase in residual electric potential with repeated use can be minimized by using these resins. The layer thickness of the charge generating layer is preferably in the range of 0.3 to 2 μm.

Charge Transporting Layer (CTL)

A charge transporting layer is a layer aiming to hold a charging electric charge and to combine by shifting an electric charge which generates and separates in a charge generating layer by exposure with the holding charging electric charge. In order to attain the object to hold the charging electric charge, a high electric resistance is required. Further, in order to attain the object to obtain a high surface potential with the holding charging electric charge, a low permittivity and a good charge transporting ability are required. The relevant charge transporting layer satisfying these requirements is structured by a charge transporting material (CTM) and a binder resin used as needed. The charge transporting layer can be formed by dissolving or dispersing these charge transporting materials and the binder resin into a suitable solvent and by coating and drying these materials. For the relevant charge transporting layer, as needed, in addition to the charge transporting material and the binder resin, a proper quantity of additives, such as plasticizer, antioxidant, and leveling agent etc, can also be added. As a charge transporting material, although there are a positive hole transporting material and an electron transporting material, in the layer structure of the organic photoreceptor of the present invention, the positive hole transporting material is desirable.

A charge transporting layer contains a charge transporting material (CTM) and a binder resin for dispersing the CTM and forming a layer. In addition to the fluorine based resin particles, the charge transporting layer may contain additives such as an antioxidant agent if necessary.

As a charge transporting material (CTM), a known charge transporting material (CTM) of the positive hole transportation type (P type) can be used. For example, triphenylamines, hydrazones, styryl compound, benzidine compound, butadiene compound can be applied. These charge transporting materials are usually dissolved in a proper binder resin to form a layer.

As a charge transporting material according to the invention, a material in which the mobility of charge is relatively high, the dispersibility into the inside of a binder is excellent and the potential characteristics is stable is preferable, especially, the compound of the following general formula (4) is more desirable.

General formula (4)

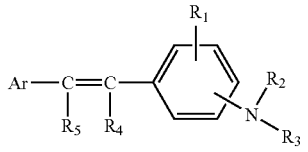

In the general formula (4), R1 represents a hydrogen atom, an alkyl group, an alkoxy group, or a halogen atom, R2 and R3 represent a substituted or unsubstituted alkyl group, a substituted or unsubstituted aralkyl group or a substituted or unsubstituted aryl group, R2 and R3 are same with or different from each other. R4 and R5 represent a hydrogen atom, a low-grade alkyl group, or a substituted or unsubstituted aryl group, Ar represents a substituted or unsubstituted aryl group, and Ar and R5 may combine with each other so as to form a ring.

CTM-1

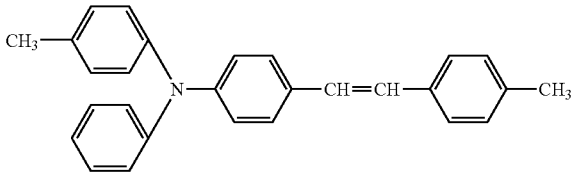

CTM-2

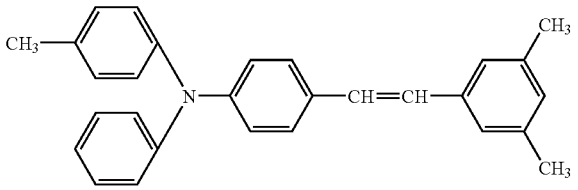

CTM-3

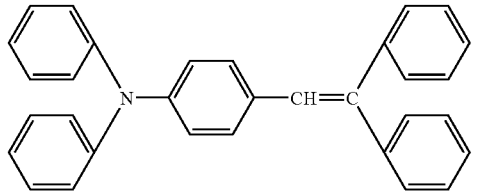

-continued
CTM-4
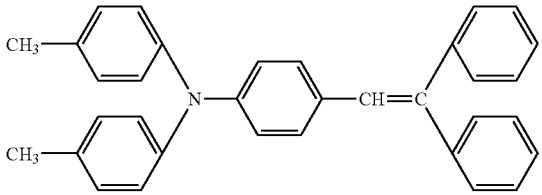
CTM-5
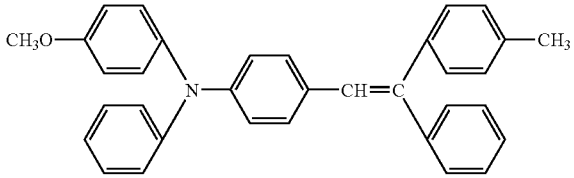
CTM-6
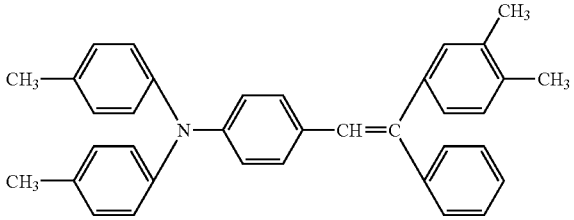
CTM-7
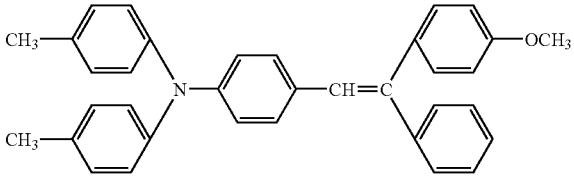
CTM-8
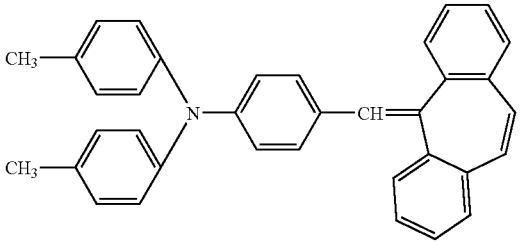
CTM-9
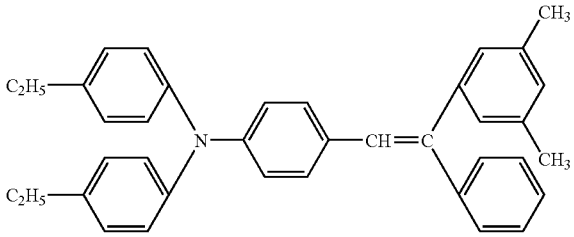
CTM-10
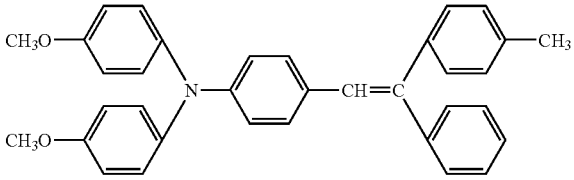
-continued
CTM-11
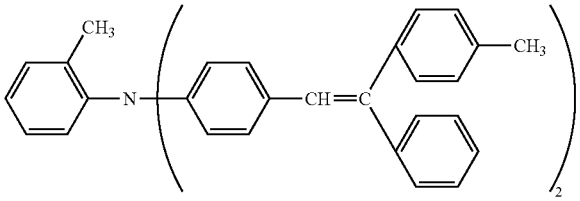
CTM-12
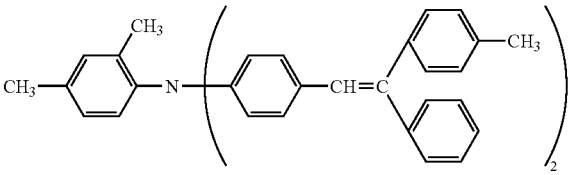
CTM-13
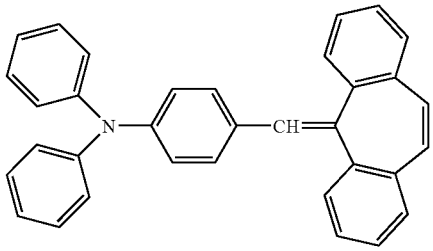
CTM-14
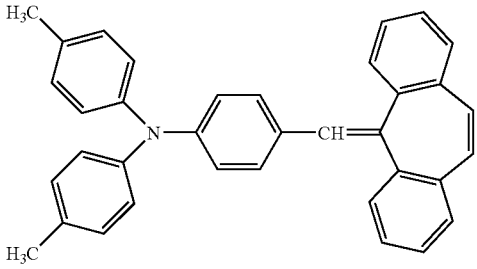
CTM-15
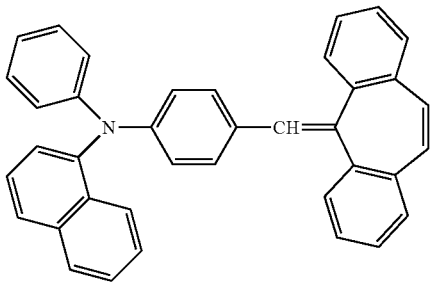
CTM-16
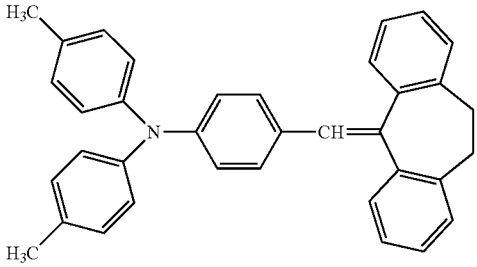

-continued

CTM-17

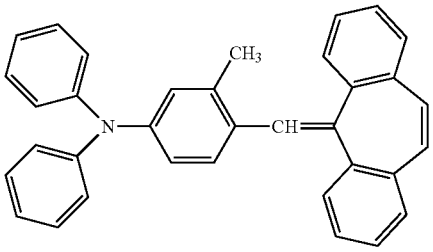

As the binder resin for charge transporting layer (CTL), any one of thermoplastic resin and thermosetting resin may be used. For example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resin, high polymer organic semiconductor such as poly —N— vinyl carbazole may be usable. The most preferred material is polycarbonate resin in view of, smaller water absorbing rate, dispersing ability of the CTM and electro photosensitive characteristics.

Ratio of the binder resin is preferably 50 to 200 parts by weight to 100 parts of charge transporting material by weight. Total thickness of the CTL is preferably 10-40 μm. CTL which is positioned at the surface layer is preferably 0.5-10 μm.

Moreover, it is preferable to make the surface layer containing the fluorine-containing resin fine particles contain an antioxidant. Although the surface layer containing a fluorine-containing resin fine particles tends to oxidize with activated gas at the time of charging of a photoreceptor, for example, NOx, ozone, etc., and easily generates a blur image, the occurrence of a blur image can be prevented by making an antioxidant exist together with it. Here, as an added amount of the antioxidant, 0.1 parts to 50 parts is to 100 parts of binders in the surface phase, preferably 0.5 parts to 25 parts. The antioxidant is a material, as a typical one, having a character to prevent or control an action of oxygen under conditions, such as light, heat, and electric discharge, to an auto-oxidizing substance which exists in an organic photoreceptor or on the surface of an organic photoreceptor. Typically, the following compound groups are listed.

1-1

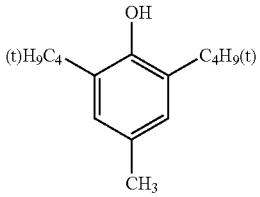

1-2

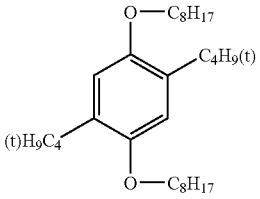

1-3

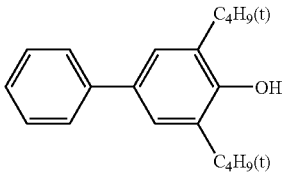

1-4

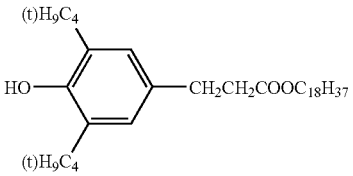

1-5

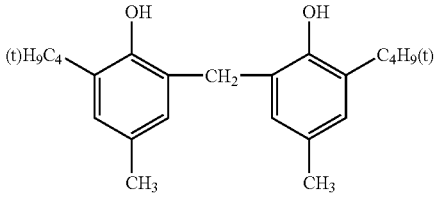

1-6

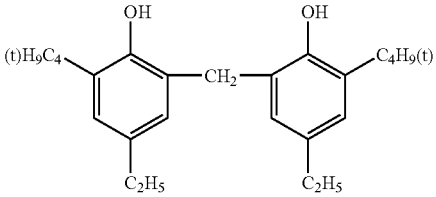

1-7

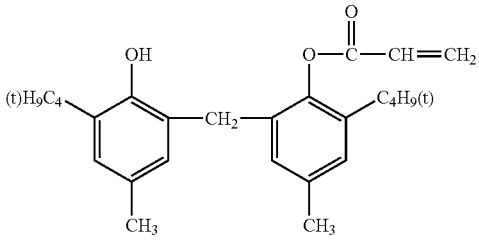

1-8

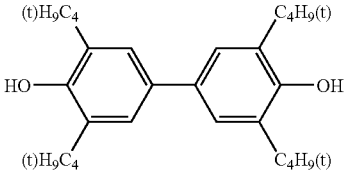

-continued
1-9
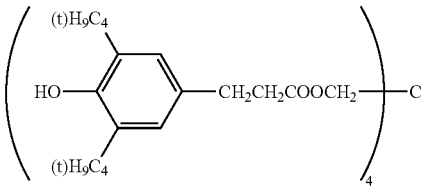
1-10
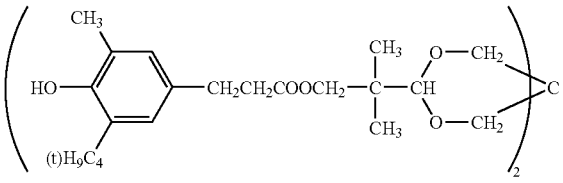
1-11
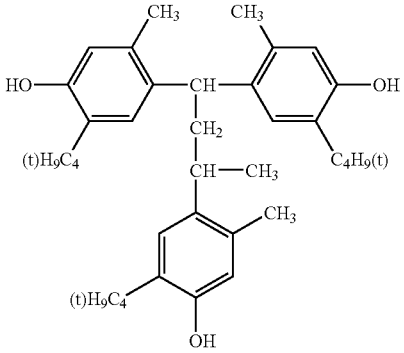
2-1
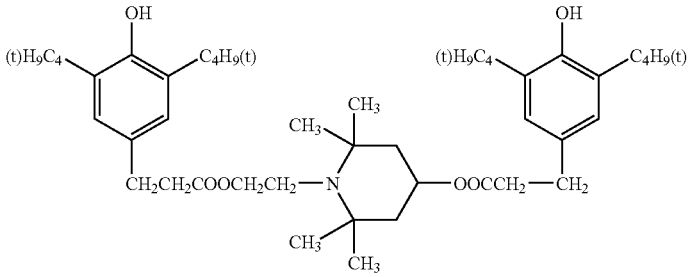
2-2
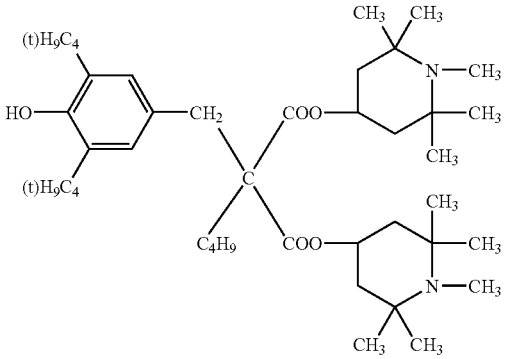
2-3
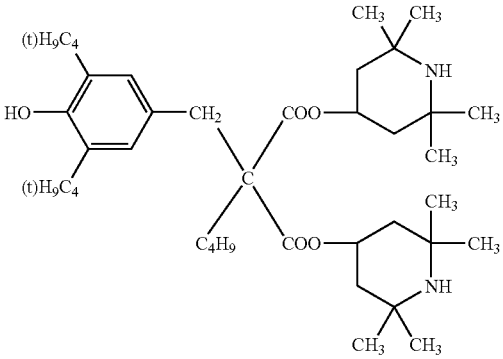
2-4
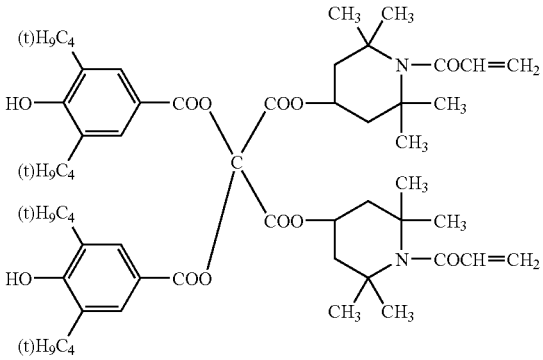
2-5
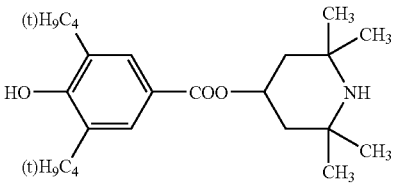

-continued 2-6

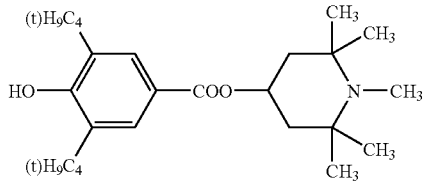

2-7

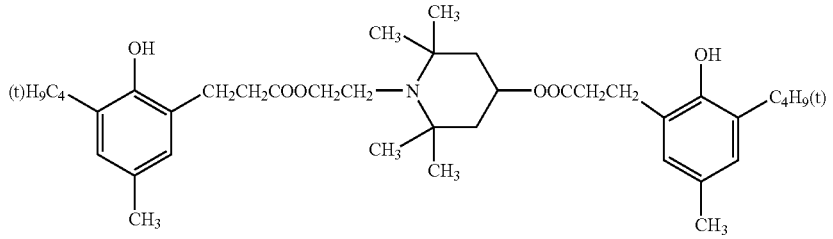

Moreover, the structure in which the uppermost layer of the photoreceptor according to the invention contains fluorine-containing resin fine particles is desirable. By making the uppermost layer contain fluorine-containing resin fine particles, a transferring ability of a toner image formed on the photoreceptor to a transfer sheet is enhanced and the reproducibility of a dot image can be increased.

As a solvent or a dispersion medium used for forming an intermediate layer, a photosensitive layer and a protective layer, n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve may be listed. The present invention is not restricted to these one, dichloromethane, 1,2-dichloro ethane and methyl ethyl ketone are used preferably. Further, these solvents or dispersion media may also be used either independently or as mixed solvents of two or more types.

Referring to FIG. 1, the developing device of the counter developing mode will be described. Incidentally, the developing device shown in FIG. 1 is a developing device with a contact type two component developing method. However, the invention is not limited to the contact type two component developing method. For example, the invention is applied to a non-contact type one component developing method. The developing device 102 is arranged in such a manner that, at the opening part of the developing container 110 in which two-component developer is accommodated, the developing sleeve (a developing agent carrying member) 120 in which cylindrical magnet 121 is non-rotationally arranged, is arranged oppositely to the organic photoreceptor (an image carrying member) 101, and this developing sleeve 120 is rotated in the counter direction to the organic photoreceptor 101 rotating in the arrowed direction, and the developer attracted to and held on its surface is conveyed to a developing section opposed to the organic photoreceptor 101. The magnet 121 has the developing magnetic pole N1 on the organic photoreceptor 101 side, and has, from this developing magnetic pole N1 to the rotation direction of the developing sleeve 120, the first conveying magnetic pole S3, the second conveying magnetic pole N2, the third conveying magnetic pole S2 and a draw-up magnetic pole S1 in which the third conveying magnetic pole and a separation magnetic pole are structured.

The developer in the developing container 110 is attracted and held on the developing sleeve 120 by the action of the draw-up pole S1, at the position (draw-up position) Q on the surface of the developing sleeve 120 corresponding to the draw-up magnet pole S1 of the magnet 121, and arrives at the developing section after the layer thickness is regulated by the developing blade (a developing agent layer thickness regulating member) 122, and in the developing section, the magnetic brush (developing brush) is formed by the action of the developing magnetic pole N1, and the latent image on the organic photoreceptor 101 is developed.

The developer whose toner density is lowered by the development, is held on the developing sleeve 120 and returned to the inside of the developing container 110 by the action of the first, second conveying magnet poles S3, N2, and at the position (developer falling position) P on the surface of the developing sleeve 120 whose magnetic flux density is smallest, between the third conveying magnet pole S2 and the draw-up magnet pole S1, it is peeled off from the developing sleeve 120, and is dropped. On the developing sleeve from which the developer is peeled off, as described above, the new developer is attracted and held at the draw-up position Q.

Below the developing sleeve 120 in the developing container 110, the first mixing conveying member 123 is provided, and the second mixing conveying member 124 is further provided through the partition wall 140. These first, second mixing conveying members 123, 124 are screw type ones, and have spiral screw blade 128 and plate-like protrusion 130 between collars of its blade.

The developer whose toner density is low, which is peeled off from the developing sleeve 120, drops on the first mixing conveying member 123, and mixing-conveyed by the first mixing conveying member 123 together with the neighboring developer in the axial direction, and passes through the opening, not shown, of the one end portion of the partition wall 140, and it is delivered to the second mixing conveying member 124. The second mixing conveying member 124 conveys the delivered developer and the toner replenished from the replenishing port 118 of the developing container 110 while mixing them, in the rotation direction reverse to the above description, and passing through the opening, not shown, of the other end portion of the partition wall 140, returns them to the first mixing conveying member 123 side.

A preferred embodiment of a counter developing mode is explained. Incidentally, here, a gap between the photoreceptor 101 and the developing sleeve 120 in the developing section neighboring the developing magnet N1 in FIG. 1 is called a developing gap (Dsd), and the height of the magnetic brush formed on the developing sleeve 120 by the developing magnet N1 is called a developing brush height (h).

(1) Developing Gap (Dsd): 0.2 to 0.6 mm

When Dsd is made 0.2 to 0.6 mm, the development is conducted under a strong developing electric field and the attraction force to attract magnetic carriers onto the developing sleeve become larger so that the magnetic carriers are prevented from shifting and adhering onto the photoreceptor. Further, the developing electric field in the developing gap becomes higher, an edge effect becomes reduced and a developing ability is enhanced. Therefore, thinning of a transverse line image and a whitening of a trailing edge portion (developing failure at a trailing edge portion) can be prevented and the developing ability for a solid image can be enhanced.

(2) Magnetic Brush Bent Depth (Bsd): 0 to 0.8 mm, here, the magnetic brush bent depth (Bsd)=the developing brush height (h)−the developing gap (Dsd)

When the magnetic brush bent depth (Bsd) is made 0 to 0.8 mm, the compression for the developing agent at the developing section is reduced and developing agent is prevented from slipping through a gap between the developing sleeve 120 and the developing blade 122. A developing failure for an isolating dot caused by an uneven contact of a magnetic brush and an increase of a roughness on a halftone image can be prevented. When the magnetic brush bent depth (Bsd) is less than zero, that is, under non contact condition, lowering of a developing density tends to take place. On the other hand, when the magnetic brush bent depth (Bsd) is larger than 0.8 mm, the developing agent flows out from a nip section and a even image formation is not expected.

(3) Peripheral Speed Ratio of Developing Sleeve to Photoreceptor (Vs/Vopc): 1.2 to 3.0

When the peripheral speed ratio of developing sleeve to photoreceptor (Vs/Vopc) is made 1.2 to 3.0, a high developing ability can be obtained. If the peripheral speed ratio is increased excessively, the contact frequency of magnetic brush on the developing sleeve against the photoreceptor becomes high excessively. Then, the contacting force of the magnetic brush against the photoreceptor, that is, a mechanical force becomes strong excessively and carrier tends to separate away from the magnetic brush and the carrier tends to adhere onto the photoreceptor. As a result, a brush mark is caused on a toner image on the photoreceptor by the magnetic brush. On the contrary, if the peripheral speed ratio is decreased excessively, the contact frequency of magnetic brush on the developing sleeve against the photoreceptor reduces excessively, the developing ability is lowered. Therefore, when the peripheral speed ratio is less than 1.2, the image density becomes low, and when the peripheral speed ratio is larger than 3.0, toner scattering, carrier adhesion, a durability problem of the developing sleeve may take place. In contrast, when the peripheral speed ratio is made within the above range, the brush mark can be prevented. Further, the edge effect is prevented from being enhanced due to an excessive high developing ability.

(4) Developing Bias Condition

It is desirable that a difference |Vo−Vdc| between the surface electric potential Vo of the photoreceptor and a direct-current component Vdc of a developing bias is made 100 to 300 V, a direct-current component Vdc of a developing bias is made −300 V to −650 V, an alternate current component Vac of the developing bias is made 0.5 to 1.5 KV, frequency is made 3 to 9 KHz, duty ratio is made 45 to 70% (the time ratio of the developing side in a rectangular wave), the shape of the alternate current component is made to be a rectangular wave. Namely, in a small size two component type developing apparatus in which the outer diameter of the developing sleeve is 30 mm or less and the outer diameter of the photoreceptor is 60 mm or less, since a developing nip width becomes small due to the small diameter of the developing sleeve, the developing ability becomes lowered. However, with the above developing bias condition, the lowering of the developing ability can be improved.

Next, a process cartridge and the electronic photographing apparatus according to the present invention will be described. A schematic structure of the electronic photographing apparatus having the process cartridge having the organic photoreceptor of the present invention is shown in FIG. 2.

Figure 2:
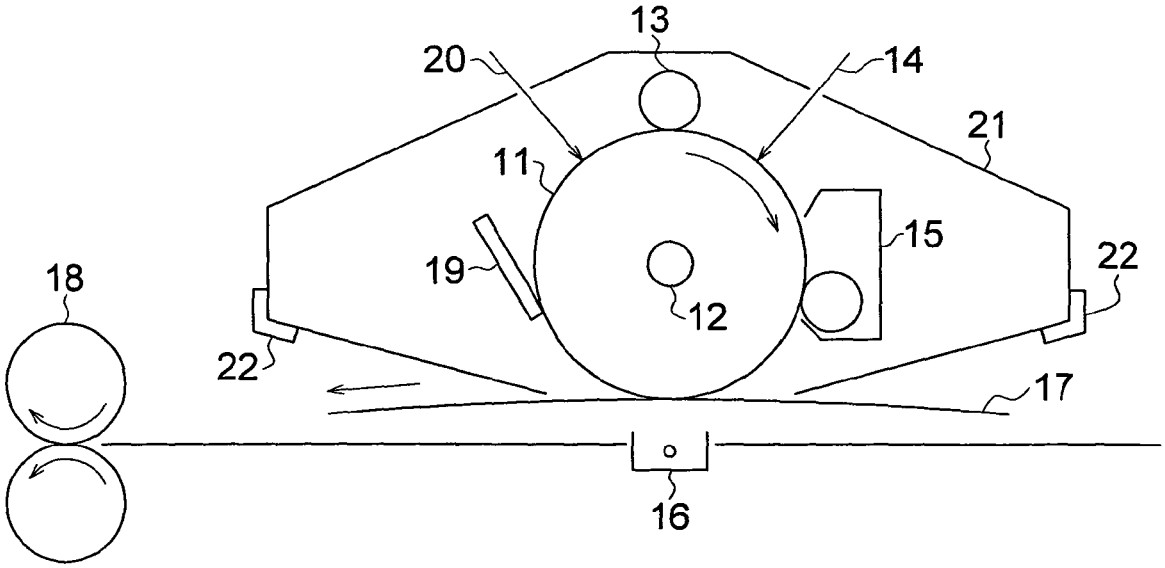
FIG. 2 is a view showing an example of schematic structure of an electronic photographing apparatus having a process cartridge having an organic photoreceptor of the present invention.

In FIG. 2, numeral 11 is a drum-like organic photoreceptor of the present invention, and is rotated at a predetermined peripheral speed in the arrowed direction around the axis 12. In the rotation process, the organic photoreceptor 11 receives the uniform charging of the positive or negative predetermined potential on its peripheral surface by the primary charging means 13, next, receives the emphasized and modulated exposure light 14 corresponding to the time series electric digital image signal of the image information for the purpose that it is outputted from the exposure means (not shown) such as a slit exposure or laser beam scanning exposure. In this manner, on the peripheral surface of the organic photoreceptor 11, electro-static latent images corresponding to a target image information are successively formed.

The formed electro-static latent image is next toner-developed by the developing means 15, and onto the transfer material 17 which is taken out and fed from the sheet feeding section, not shown, in timed relationship with the rotation of the organic photoreceptor 11 between the organic photoreceptor 11 and the transfer means 16, the toner images which are formed and held on the surface of the organic photoreceptor 11, are successively transferred by the transfer means 16.

The transfer material 17 onto which the toner image is transferred, is separated from the surface of the organic photoreceptor and when it is introduced into the image fixing means 18 and image-fixed, printed out to the outside of the apparatus as the image formed material (print, copy).

The surface of the organic photoreceptor 11 after the image transferring, is cleaned when the remained toner of the transferring is removed by the cleaning means 19, and further after the surface is discharging-processed by the pre-exposure light 20 from the pre-exposure means (not shown), it is repeatedly used for the image formation. Hereupon, when the primary charging means 13 is a contact charging means using the charging roller, the pre-exposure is not always necessary.

In the present invention, in the components such as the above organic photoreceptor 11, primary charging means 13, developing means 15 and cleaning means 19, a plurality ones are accommodated in a casing 21 and structured by being integrally combined as a process cartridge, and this process cartridge may also be detachably structured for the electronic photographing apparatus main body such as the copier or laser beam printer. For example, at least one of the primary charging means 13, developing means 15 and cleaning means 19, is integrally supported with the organic photoreceptor 11 and made into the cartridge, and by using the guiding means 22 such as rails of the apparatus main body, it can be made a process cartridge which is detachable for the apparatus main body.

Further, an embodiment of a printer of the electronic photographing system (hereinafter, simply called printer) as the full-color image forming apparatus to which the present invention is applied, will be described bellow.

Figure 3:
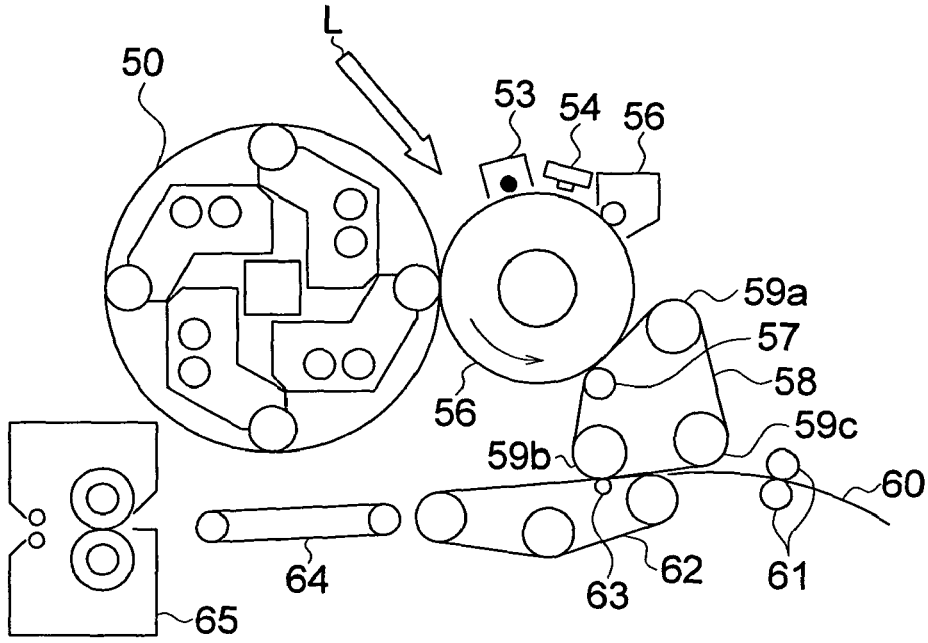
FIG. 3 is a schematic structural view of a printer which is an example of an image forming apparatus of the present invention.

FIG. 3 is a schematic structural view of a printer according to the present embodiment. In FIG. 3, while the photoreceptor 56 as the latent image carrier is rotated in the counterclockwise direction, after its surface is uniformly charged by the charging charger 53 using a corotron, or scorotron, when the laser light L projected from the laser optical apparatus scans the surface, the photoreceptor holds the electro-static latent image. Because this scanning is conducted based on a monochromatic image information in which the full-color image is resolved into the chromatic information of yellow, magenta, cyan, and black, on the photoreceptor drum 56, the electrostatic latent image for the monochrome of yellow, magenta, cyan, or black is formed. On the left side in the view of the photoreceptor drum 56, a revolver developing unit 50 is provided. This has the yellow developing unit, magenta developing unit, cyan developing unit and black developing unit in the rotating drum-like casing, and each of developing units is successively moved at the developing position opposed to the photoreceptor drum 56 by the rotation. Hereupon, the yellow developing unit, magenta developing unit, cyan developing unit and black developing unit respectively adhere the yellow toner, magenta toner, cyan toner, and black toner, and develop the electro-static latent image. On the photoreceptor drum 56, the electro-static latent images for yellow, magenta, cyan, black are successively formed, and they are successively developed by each developing unit of the revolver developing unit 50, and become yellow toner image, magenta toner image, cyan toner image and black toner image.

On the rotation downstream side of the photoreceptor drum 56 from the developing position, an intermediate transfer unit is provided. The intermediate transfer belt 58 which is stretched by a stretching roller 59*a*, an intermediate transfer bias roller 57 which is a transfer means, a secondary transfer back-up roller 59*b*, and a belt drive roller 59*c*, is endlessly moved clockwise in the view, by the rotation of the belt drive roller 59*c*. The yellow toner image, magenta toner image, cyan toner image and black toner image, developed on the photoreceptor drum 56, enter into an intermediate transfer nip at which the photoreceptor drum 56 is brought into contact with an intermediate transfer belt 58. Then, while they are affecting the influence of the bias from the intermediate transfer bias roller 57, they are superimposed on the intermediate transfer belt 58 and intermediate-transferred, and 4-color superimposed toner image is formed.

On the photoreceptor drum 56 surface passed through the intermediate transfer nip following the rotation, the transfer remaining toner is cleaned by the drum cleaning unit 55. This cleaning unit 55 is a unit which cleans the transfer remaining toner by the cleaning roller on which the cleaning bias is impressed, however, it may also be a unit using a cleaning brush composed of a fur brush, mag-fur brush, or a cleaning blade.

The surface of the photoreceptor 56 on which the transfer remaining toner is cleaned, is discharged by a discharging lamp 54. As the discharging lamp 54, a fluorescent lamp, tungsten lamp, halogen lamp, mercury lamp, sodium lamp, light-emitting diode (LED), semiconductor laser (LD), electro-luminescence (EL) are used. Further, as the light source of the above laser optical apparatus, a semiconductor laser is used. For the emitted light, only a desired wavelength area may also be used by each kind of filter such as a sharp-cut filter, band-pass filter, near infrared cut filter, dichroic filter, interference filter, color-temperature conversion filter.

On the down side of the intermediate transfer unit in the view, a transfer unit composed of each kind of roller such as the transfer belt and transfer bias roller, drive roller is arranged, and on the left side in the view, a conveying belt 64 and a fixing unit 65 are arranged. In the transfer unit, the transfer belt which is endlessly moved, may also be formed to move upside and downside in the view by the moving means, not shown, and at least, when one color toner image (yellow toner image) or 2-color or 3-color superimposed toner images on the intermediate transfer belt 58, pass the opposed position to the sheet transfer bias roller 63, they are retreat-moved to the position at which is not brought into contact with the intermediate transfer belt 58. Then, before the leading edge of the 4-color superimposed toner images enter into the opposed position to the sheet transfer bias roller 63, it is moved to the contact position with the intermediate transfer belt 58, and the secondary transfer nip is formed.

On the one hand, the register roller pair 61 which nips the transfer sheet 60 fed from the sheet feed cassette, not shown, between 2 rollers, feeds the transfer sheet 60 to the secondary transfer nip at the timing at which the transfer sheet 60 can be superimposed on the 4-color superimposed toner image on the intermediate transfer belt 58. The 4-color superimposed toner images on the intermediate transfer belt 58 are collectively secondary-transferred onto the transfer sheet P when the influence of the secondary transfer bias from the sheet transfer bias roller 63 is affected in the secondary transfer nip. By this secondary transfer, the full-color image is formed on the transfer sheet 60.

The transfer sheet 60 on which the full-color image is formed, is sent to the sheet conveying belt 64 by the transfer belt 62.

The conveying belt 64 sends the transfer sheet 60 received from the transfer unit into the fixing unit 65. The fixing unit 65 conveys the sent transfer sheet 60 while nipping it in the fixing nip formed by the contact of the heat roller with the back-up roller.

The full-color image on the transfer sheet 60 is fixed on the transfer sheet 60 when the influence of the heat from the heat roller or the pressing force in the fixing nip is affected.

Hereupon, although the illustration is neglected, on the transfer belt 62 or conveying belt 64, the bias voltage for attracting the transfer sheet P is impressed. Further, the sheet discharging charger for discharging the transfer sheet 60, or 3 belt discharging chargers for discharging each of belts (intermediate transfer belt 58, transfer belt 62, conveying belt 64) are arranged. Further, the intermediate transfer unit is also provided with the belt cleaning unit whose structure is the same as the drum cleaning unit 55, and the transfer remaining toner on the intermediate transfer belt 58 is cleaned hereby.

Figure 4:
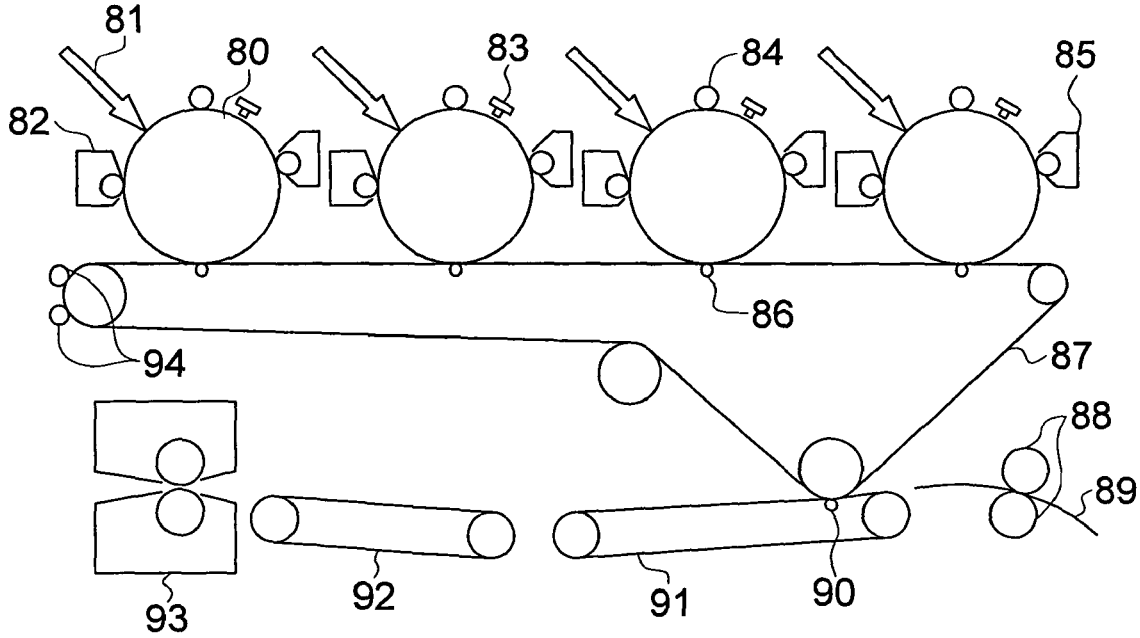
FIG. 4 is a schematic structural view of a modified apparatus example of the printer which is an example of the image forming apparatus of the present invention.

FIG. 4 is a modified example of the printer according to the present embodiment. This apparatus is a so-called tandem system printer, and the photoreceptor drum 80 is not commonly owned by each color, but the apparatus is provided with the photoreceptor drums for each color 80Y, 80M, 80C, 80BK. Further, the drum cleaning unit 85, discharging lamp 83, charging roller 84 by which the drum is uniformly charged, are also provided with units for each color. Further, in FIG. 4, numeral 81 shows the exposure light, numeral 82 shows the developing unit, numeral 83 is the discharging lamp, numeral 86 is a transfer bias roller, numeral 87 is the intermediate transfer belt, numeral 88 is the register roller of the transfer sheet 89, numeral 90 is the transfer bias roller, numeral 91 is the transfer belt, numeral 92 is the conveying belt, numeral 93 is the fixing unit, and numeral 94 shows the fur-brush. Hereupon, in the printer shown in FIG. 3, although the charging charger 53 is provided as the drum uniform charging means, in this printer, the charging roller 84 is provided. In the tandem system, because the latent image formation or development for each color can be conducted in parallel to each other, the image formation speed can be further made into high speed than that of the revolver system.

EXAMPLES

Although examples are given and this invention is hereafter explained to details, the aspect of this invention is not limited to this. Incidentally, "part" in the following sentences represents "parts by weight".

Manufacture of Photoreceptor 1

<Intermediate Layer 1>

The cylinder type aluminum base support, which surface has 10 points surface roughness Rz of 0.81 μm measured according to regulation of JISB-0601 by subjecting to cutting process and washed, was subjected to coating with the following interlayer coating composition by dipping and thereafter drying, an interlayer having dry thickness of 3.0 μm was prepared.

The following intermediate layer dispersion liquid was diluted twice with the same mixed solvent, and filtered after settling for overnight (filter; Nihon Pall Ltd. company make RIGIMESH 5 μm filter), whereby the intermediate layer coating solution was produced.

| (Preparation of intermediate layer dispersion) | |
|---|---|
| Binder resin, exemplified Polyamide N-1) | 1 part (1.0 part by volume) |
| Anatase type titanium oxide A1 (number average primary particle diameter of 35 nm: subjected to surface treatment with titanium oxide in amount of 5 weight % of the total amount of the titanium oxide) by the use of a copolymer of methyl hydrogen polysiloxane and dimethylsiloxane (molar ratio = 1:1) | 3.5 parts (1.0 part by volume) |
| Ethanol/n-propyl alcohol/THF (=45/20/30 by weight) | 10 parts |

The above-mentioned composites were mixed, dispersion was performed for 10 hours by a batch system, using a sand mill homogenizer, and whereby intermediate layer dispersion liquid was produced.

Charge Generating Layer

The following compositions were mixed and dispersed by use of a sand mill, whereby a charge generating layer coating liquid was prepared. This liquid was coated on the aforesaid intermediate layer by means of an immersion coating method to form a charge generating layer having a dry layer thickness of 0.3 μm.

| | |
|---|---|
| Charge generating material (Gl): (Y type titanyl phthalocyanine pigment having the maximum diffraction peak at 27.3° on Bragg angle (2θ ± 0.2°) in a Cu-Kα characteristic X-ray diffraction spectrum) | 20 parts |
| Silicon modified polyvinyl butyral | 10 parts |
| 4-methoxy-4-methyl-2-pentanone | 700 parts |
| t-Butyl acetate | 300 parts |

Charge Transporting Layer

The following compositions were mixed and dissolved, whereby a charge transporting layer coating liquid was prepared. This coating liquid was coated on the above charge generating layer with an immersion coating method, whereby a charge transporting layer having a dried layer thickness of 25 μm was formed and Photoreceptor 1 was produced.

| | |
|---|---|
| Charge transporting material (CTM-4) | 70 parts |
| Binder resin (Exemplified compound BPZ(Mv: 30000)) | 100 parts |
| Anti-oxidant (Exemplified compound 1-1) | 8 parts |
| Tetrahydrofuran/toluene (Volume ratio 8/2) | 750 parts |

Preparation of Photoreceptors 2 Through 16

Photoreceptors 2 through 16 were prepared in the same manner as in Photoreceptor 1 except that the N-type semiconductor particles in the intermediate layer, binder resin and dried layer thickness, charge generating material, charge transporting material in the charge transporting layer, and a later thickness were changed as shown in Table 1. Here, an intermediate layer dispersion liquid was produced and an intermediate layer was formed in such a way that the total volume of the volume of binder resins and the volume of N-type semiconductor particles in all of the intermediate layers of Photoreceptors 1 to 15 were made constant and the volume ration (Vn/Vb) of the volume of binder resins and the volume of N-type semiconductor particles was changed. Here, Photoreceptor 16 was produced by eliminating N-type semiconductor particles from the intermediate layer of Photoreceptor 1.

Incidentally, at the same time with the production of Photoreceptors 1 to 16, each of the intermediate layer coating liquids was coated on an aluminum-deposited polyethylene terephthalate base support and then an intermediate layer having a dried layer thickness of 10 μm was formed on the same condition as the drying condition for the photoreceptors, whereby samples for a volume resistance measurement were prepared and the volume resistance of each intermediate layer was measured. As a result, the volume resistance of all of Photoreceptors 1 to 16 were $1\times10^8$ Ω·cm or more. The structural formula of the binder resin (BPZ) used for Photoreceptors 1 to 16 is shown below.

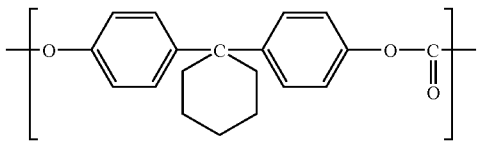

PC-Z(BPZ)

TABLE 1

| | Intermediate layer | | | | | | | | | | | | |
|---|---|---|---|---|---|---|---|---|---|---|---|---|---|
| | N-type semiconductive particles | | | Binder resin | | | | | | | | | |
| Photo-Recepor No. | Kind of particles | Number average primary order particles size (nm) | Surface treat-ment | Kind | Melting heat (J/g) | Water absorption rate (wt %) | Ratio of a unit structure having a carbon number of 7 or more (mol %) | Volume ratio Vn/Vb | Layer thick-ness (μm) | CGL Charge generating materials | CTL Charge transporting material | CTL Layer Thickness (μm) | Remarks |
| 1 | A1 | 35 | *1 | N-1 | 0 | 1.9 | 100 | 1.0 | 3.0 | G1 | CTM-4 | 25 | Inv. |
| 2 | A1 | 35 | *2 | N-2 | 0 | 2 | 100 | 0.7 | 3.0 | G2 | CTM-4 | 25 | Inv. |
| 3 | A1 | 35 | *3 | N-3 | 0 | 2.8 | 45 | 1.0 | 3.0 | G3 | CTM-4 | 25 | Inv. |
| 4 | A2 | 35 | *4 | N-6 | 12 | 3.4 | 65 | 1.0 | 3.0 | G1 | CTM-4 | 25 | Inv. |
| 5 | A2 | 35 | *5 | N-7 | 28 | 3.8 | 60 | 1.0 | 5.0 | G1 | CTM-4 | 25 | Inv. |
| 6 | A1 | 35 | *6 | N-8 | 23 | 4.5 | 45 | 1.0 | 3.0 | G1 | CTM-4 | 25 | Inv. |
| 7 | A1 | 180 | *1 | N-1 | 0 | 1.9 | 100 | 1.0 | 3.0 | G1 | CTM-4 | 25 | Inv. |
| 8 | A1 | 35 | *1 | N-1 | 0 | 1.9 | 100 | 1.0 | 0.5 | G1 | CTM-12 | 20 | Inv. |
| 9 | A1 | 5 | *1 | N-1 | 0 | 1.9 | 100 | 1.0 | 3.0 | G1 | CTM-4 | 25 | Inv. |
| 10 | Z | 100 | *1 | N-1 | 0 | 1.9 | 100 | 1.0 | 3.0 | G1 | CTM-4 | 25 | Inv. |
| 11 | A1 | 2 | *1 | N-1 | 0 | 1.9 | 100 | 1.0 | 3.0 | G1 | CTM-4 | 25 | Comp. |
| 12 | A1 | 220 | *1 | N-1 | 0 | 1.9 | 100 | 1.0 | 3.0 | G1 | CTM-4 | 25 | Comp. |
| 13 | A1 | 35 | *1 | N-1 | 0 | 1.9 | 100 | 2.3 | 3.0 | G1 | CTM-4 | 25 | Inv. |
| 14 | A1 | 35 | *1 | N-1 | 0 | 1.9 | 100 | 1.0 | 3.0 | G1 | CTM-4 | 15 | Inv. |
| 15 | A1 | 35 | *7 | N-1 | 0 | 1.9 | 100 | 1.0 | 10.0 | G1 | CTM-14 | 25 | Inv. |
| 16 | — | — | — | N-1 | 0 | 1.9 | 100 | — | 3.0 | G1 | CTM-4 | 25 | Comp. |

In Table 1, G1, G2, and G3 represent the following charge generating materials respectively.

G1: Y type titanyl phthalocyanine pigment having the maximum diffraction peak at 27.3° on Bragg angle (2θ±0.2°) in a Cu—Kα characteristic X-ray diffraction spectrum, G2: Hydroxy gallium phthalocyanine pigment having distinctive diffraction peak at at least 7.5°, 9.9°, 12.5°, 16.3°, 18.6°, 25.1°, 28.1° on Bragg angle (2θ±0.2°) in a Cu—Kα characteristic X-ray diffraction spectrum, and G3: Chloro gallium phthalocyanine pigment having distinctive diffraction peak at at least 7.4°, 16.6°, 25.5°, 28.3° on Bragg angle (2θ±0.2°) in a Cu—Kα characteristic X-ray diffraction spectrum.

A1 represents a rutile-type titanium oxide, and

A2 represents an anatase-type titanium oxide.

Z is a zinc oxide.

*1 is copolymer of methylhydrogensiloxane and dimethylsiloxane whose molecular ratio of 1:1,

*2 is copolymer of methylhydrogensiloxane and dimethylsiloxane whose molecular ratio of 9:1,

*3 is copolymer of methylhydrogensiloxane and dimethylsiloxane whose molecular ratio of 2:8,

*4 is copolymer of ethylhydrogensiloxane and dimethylsiloxane whose molecular ratio of 1:1,

*5 is copolymer of methylhydrogensiloxane and methylethylsiloxane whose molecular ratio of 1:1, and

*6 is methylhydrogenpolysiloxane.

Incidentally, in Table 2, "surface treatment" is a substance used in the surface treatment applied for the surface of particles. (here, silica alumina in the primary treatment means silica alumina deposited on the particle surface).

The heat of fusion and the water absorbing degree were measured as follows:

Measurement of Heat of Fusion

Measuring Apparatus: Shimadzu Flow Rate Differential Scanning Calorimeter DSC-50 manufactured by Shimadzu Corporation.

Measuring Condition: The sample to be measured was set in the measuring apparatus and measurement was stated at a room temperature (24° C.). The temperature was raised by 200° C. in a rate of 5° C. per minute and then cooled by the room temperature in a rate of 5° C. per minute. Such the operation was repeated two times and the heat of fusion was calculated from the area of the endothermic peak caused by the fusion in the course the secondary temperature rising.

Measuring Condition of Water Absorption Degree

The sample to be measured was satisfactorily dried at a temperature of from 70 to 80° C. spending 3 to 4 hours and the sample was precisely weighed. After that the sample was put into deionized water kept at 20° C. and taken out after a designated period and water adhered at the surface of the sample was wiped off by a clean cloth, and then the sample was weighed. Such the operation was repeated until the increasing of the weight was saturated. Thus measured increased weight of the sample was divided by the initial weight. The quotient was defined as the water absorption degree.

In the Table 2, "Ratio of structural unit having 7 or more carbon atoms" is the ratio in mole-% of the structural unit having 7 or more carbon atoms between the amide bonds in the structural unit.

<Evaluation by a Counter Developing Mode>

The obtained photoreceptors were mounted in a modified machine of a commercially available full color compound machine 8050 (manufactured by Konica Minolta Business Technologies), and image evaluation was conducted.

<Evaluation 1>

As process conditions for a counter developing mode, Evaluation 1 was conducted by the use of the following conditions.

Peripheral speed of photoreceptor: 280 mm/sec

Magnetic brush bent depth (Bsd); 0.30 mm

Developing gap (Dsd); 0.28 mm

Alternate-current component of developing bias (Vac): 1.0 KVp-p

Peripheral speed ratio of a developing sleeve and a photoreceptor (Vs/Vopc): 2.0

Direct-current component of developing bias (Vdc): −500 V

Difference between the surface potential V0 of photoreceptor and the direct-current component Vdc of developing bias (|V0−Vdc|): 200 V Frequency: 3 kHz and 9 kHz Duty Ratio: 50% in a rectangular wave In the image evaluation, images were printed at room temperature.

A document image having a white portion, a halftone portion, a black solid portion, a red, green and blue solid portion and a character image portion was printed on 10,000 sheets, and printed document images were evaluated.

The results are shown in Table 2.

<Image Evaluation> a. Worm-Like Unevenness

The presence or absence of worm-like unevenness was observed and evaluated by checking a halftone picture image on a 10,000$^{th}$ printed sheet with a magnifying glass (×20).

AA: Occurrence of unevenness was not observed.

A: Unevenness was observed slightly, but there was no problem.

C: There was unevenness which was observed in a form of wavelike unevenness and it was problem for a practical use.

b. Fog

Fog density was measured for a sheet at the time of staring printing and a 10,000$^{th}$ printed sheet by the use of a densitometer "RD-918" (made by Macbeth) as a relative density for a reflection density of A4 size sheet set to be 0.000.

AA: It was less than 0.010 (appreciably excellent)

A: It was 0.010 or more and less that 0.020 (it corresponded to a level that there may be no problem for a practical use.

C: It was 0.020 or more (it was practically problematic)

c. Color Reproduction Quality

Color on solid image portions of secondary color (red, blue and green) in each toner image of Y, M, and C on images of a first printed sheet and a 100$^{th}$ printed sheet by the use of "MacbethColor-Eye7000" and the color difference of the solid image on the first printed sheet and the 100$^{th}$ printed sheet was calculated by the use of a CMC (2:1) color difference formula.

AA: The color difference was smaller than 2 (excellent) A: The color differences were 2 to 3 (with no problem).

C: The color difference was larger than 3 (it was problematic practically and a practical use was not permissible)

d. Sharpness

Character collapse of the character image portion on a 10,000$^{th}$ printed sheet was evaluated. That is, 3 point and 5 point character images were formed and the character images were evaluated with the following judgment criteria.

AA: both of the 3 point and 5 point character images were clear and decipherable easily.

A: The 3 point character image partially was not decipherable, however the 6 point were character image was clear and decipherable easily.

C: The 3 point character image was almost not decipherable, and the 5 point character image partially or entirely was not decipherable.

TABLE 2

| | Image evaluation | | | | | | | |
|---|---|---|---|---|---|---|---|---|
| Photo-Receptor | Image density | Fog | Color reproducibility | Sharpness | | Worm-like unevenness | | |
| No. | 3&9 KHz | 3&9 KHz | 3&9 KHz | 3 KHz | 9 KHz | 3 KHz | 9 KHz | |
| 1 | AA | AA | AA | AA | AA | AA | AA | Inv. |
| 2 | AA | AA | AA | AA | AA | AA | AA | Inv. |
| 3 | AA | AA | AA | AA | AA | AA | AA | Inv. |
| 4 | AA | A | A | AA | AA | AA | AA | Inv. |
| 5 | AA | A | A | AA | AA | AA | AA | Inv. |
| 6 | AA | A | A | AA | AA | AA | AA | Inv. |
| 7 | AA | A | A | AA | AA | AA | AA | Inv. |
| 8 | AA | AA | AA | AA | AA | AA | AA | Inv. |
| 9 | AA | A | A | AA | AA | A | AA | Inv. |
| 10 | AA | A | A | AA | AA | AA | AA | Inv. |
| 11 | C | A | A | A | C | C | A | Comp. |
| 12 | C | C | C | C | C | A | A | Comp. |
| 13 | A | A | A | AA | AA | AA | AA | Inv. |
| 14 | A | A | A | AA | AA | AA | AA | Inv. |
| 15 | AA | A | A | AA | AA | AA | AA | Inv. |
| 16 | C | C | C | C | C | C | C | Comp. |

As can be seen from Table 2, at the image evaluation in the counter developing mode, Photoreceptors 1-10 and 13-15 in which an intermediate layer contains inorganic particles having a number average primary order particle size of 3-200 nm in a binder showed excellent characteristics in all evaluation criteria, such as fog, color reproduction ability, sharpness, and worm-like unevenness. On the other hand, in Photoreceptor 11 containing inorganic particles having a number average primary order particle size of 2 nm, an image density was lowered, sharpness and worm-like unevenness were influenced by the frequency of alternate-current component of the developing bias, and the both of the improvement in sharpness and worm-like unevenness prevention were not attained. Also, in Photoreceptor 12 containing inorganic particles having a number average primary order particle size of 220 nm, an image density was lowered, and the both of the improvement in sharpness and worm-like unevenness prevention were not attained. Moreover, Photoreceptor 16 in which an intermediate layer did no contain inorganic particles showed bad results in all evaluation criteria.

<Evaluation 2>

As shown in Table 3, Evaluation 2 was conducted by using Photoreceptor 1 for Modified machines A to E with the counter developing mode in Evaluation 1 except that only the magnetic brush bent depth (Bsd) in the process conditions was changed to −0.1 to 1.0 mm.

TABLE 3

| Modified machine No. | Photoreceptor No. | Magnetic brush bent depth | Peripheral Speed ratio of developing sleeve to photoreceptor | Alternate component of Developing bias | Image evaluation | | |
|---|---|---|---|---|---|---|---|
| | | | | | Density | Color reproducibility | Fog |
| A | 1 | 0 | 2.0 | 1.0 | A | AA | AA |
| B | 1 | 0.5 | 2.0 | 1.0 | AA | AA | AA |
| C | 1 | 0.8 | 2.0 | 1.0 | AA | AA | A |
| D | 1 | 1.0 | 2.0 | 1.0 | AA | A | A |
| E | 1 | −0.1 | 2.0 | 1.0 | A | A | AA |

The magnetic brush bent depth was more excellent at 0-0.8 mm.

<Evaluation 3>

As shown in Table 4, Evaluation 3 was conducted by using Photoreceptor 3 for Modified machines F to I with the counter developing mode in Evaluation 1 except that only the peripheral speed ratio in the process conditions was changed to 1 to 3.3 mm.

TABLE 4

| Modified machine No. | Photoreceptor No. | Magnetic brush bent depth | Peripheral Speed ratio of developing sleeve to photoreceptor | Alternate component of Developing bias | Image evaluation | | |
|---|---|---|---|---|---|---|---|
| | | | | | Density | Color reproducibility | Fog |
| F | 3 | 0.5 | 1.0 | 1.0 | A | A | AA |
| G | 3 | 0.5 | 1.2 | 1.0 | A | AA | AA |
| H | 3 | 0.5 | 3.0 | 1.0 | AA | AA | A |
| I | 3 | 0.5 | 3.3 | 1.0 | AA | A | A |

The peripheral speed ratio of 1.2 to 3.0 was excellent, especially 1.5 to 2.5 were more excellent.

<Evaluation 4>

As shown in Table 5, Evaluation 4 was conducted by using Photoreceptor 3 for Modified machines J to L with the counter developing mode in Evaluation 1 except that only the alternate-current component of developing bias (Vac) in the process conditions was changed to 0.3 to 1.7 mm.

TABLE 5

| Modified machine No. | Photoreceptor No. | Magnetic brush bent depth | Peripheral speed ratio of developing sleeve to photoreceptor | Alternate component of Developing bias | Image evaluation Density | Color reproducibility | Fog |
|---|---|---|---|---|---|---|---|
| J | 3 | 0.5 | 2.0 | 0.3 | A | A | A |
| K | 3 | 0.5 | 2.0 | 1.5 | A | AA | AA |
| L | 3 | 0.5 | 2.0 | 1.7 | AA | A | A |

The alternate-current component of developing bias (Vac) of 0.5 to 1.5 KVp-p was excellent.

<Evaluation 5 (Evaluation by a Parallel Developing Mode)>

Evaluation 5 was conducted with a parallel developing mode in which the moving direction of the photoreceptor was parallel to that of the developing sleeve in Evaluation 1. As a result, in comparison with the counter development mode in Evaluation 1 of the present invention, the electrophotography picture image having a lowered image density fell was obtained.

What is claimed is:

1. An image forming method, comprising the steps of:

forming an electrostatic latent image on a rotatable organic photoreceptor in a predetermined rotational direction;

forming a developing brush with a developing agent containing a toner on a rotatable developing sleeve; and contacting the developing brush on the developing sleeve with the surface of the photoreceptor such that the developing brush has a bent depth (Bsd) in the range of 0.3 to 0.8 mm at a developing region between the photoreceptor and the developing sleeve so as to visualize the electrostatic latent image into a toner image on the photoreceptor;

wherein the photoreceptor comprises a conductive support member, an intermediate layer containing a binder resin and inorganic particles and a photosensitive layer includes a charge generating layer provided on the intermediate layer, wherein the intermediate layer has a thickness of 0.3 to 10 μm, the inorganic particles are N-type semiconductive particles and have a number average primary order particle size of 3 to 200 nm, the volume of the inorganic particles is from 1.0 to 2.0 times that of the binder resin, and the charge generating layer contains 20 to 600 weight parts of a charge generating material for 100 weight parts of a binder resin and has a thickness of 0.3 to 2 μm, and wherein the rotating direction of the developing sleeve is counter to that of the photoreceptor at the developing region.

2. The image forming method of claim 1, wherein the Ntype semiconductive particles include particles of titanium oxide or zinc oxide.

3. The image forming method of claim 2, wherein the Ntype semiconductive particles include particles of titanium oxide.

4. The image forming method of claim 3, wherein the titanium oxide is a rutile type titanium oxide pigment or an anatase type titanium oxide pigment.

5. The image forming method of claim 1, wherein the Ntype semiconductive particles are applied with a surface treatment.

6. The image forming method of claim 1, wherein the binder resin of the intermediate layer comprises a polyamide resin.

7. The image forming method of claim 6, wherein the polyamide resin each having a melting heat of from 0 to 40 J/g and a water absorption rate of not more than 5 mass %.

8. The image forming method of claim 1, wherein the photosensitive layer comprises a charge generating layer and a charge transporting layer provided in this order on the intermediate layer.

9. The image forming method of claim 1, wherein the number average primary order particle size of the inorganic particles are in the range of 5 to 100 nm.

10. The image forming method of claim 1, wherein the developing gap (Dsd) between the photoreceptor and the developing sleeve is in the range of 0.3 to 0.6 mm.

11. The image forming method of claim 1, wherein the peripheral speed ratio (Vs/Vopc) of the developing sleeve and the photoreceptor is in the range of 1.2 to 3.0.

12. The image forming method of claim 11, wherein the peripheral speed ratio (Vs/Vopc) of the developing sleeve and the photoreceptor is in the range of 1.5 to 2.5.

13. The image forming method of claim 1, wherein a difference |Vo−Vdc| between the surface electric potential Vo of the photoreceptor and a direct-current component Vdc of a developing bias is in the range of 100 to 300 V, a direct-current component Vdc of a developing bias is in the range of −300 V to −650 V, an alternate current component Vac of the developing bias is in the range of 0.5 to 1.5 KV, frequency is in the range of 3 to 9 KHz, the shape of the alternate current component is a rectangular wave and a duty ratio is made 45 to 70%, where the duty ratio is the time ratio of the developing side in the rectangular wave.

* * * * *